US008506352B2

(12) United States Patent
Takeichi et al.

(10) Patent No.: US 8,506,352 B2
(45) Date of Patent: Aug. 13, 2013

(54) EYEGLASS LENS PROCESSING APPARATUS

(75) Inventors: Kyoji Takeichi, Gamagori (JP); Ryoji Shibata, Toyokawa (JP); Motoshi Tanaka, Gamagori (JP); Katsuhiro Natsume, Toyohashi (JP); Yuya Nakako, Toyota (JP)

(73) Assignee: Nidek Co., Ltd., Aichi (JP)

( * ) Notice: Subject to any disclaimer, the term of this patent is extended or adjusted under 35 U.S.C. 154(b) by 395 days.

(21) Appl. No.: 12/893,745

(22) Filed: Sep. 29, 2010

(65) Prior Publication Data

US 2011/0076923 A1 Mar. 31, 2011

(30) Foreign Application Priority Data

Sep. 30, 2009 (JP) ..... 2009-229115
Mar. 2, 2010 (JP) ..... 2010-045803

(51) Int. Cl.
*B24B 49/00* (2012.01)
*B24B 51/00* (2006.01)

(52) U.S. Cl.
USPC ..... 451/5; 318/570; 451/8; 451/43; 451/66; 451/71; 700/164; 700/172; 700/195

(58) Field of Classification Search
USPC ..... 33/504; 318/570, 572; 324/600, 324/601; 351/178; 451/5, 6, 8, 9, 10, 11, 451/43, 44, 65, 66, 67, 71; 700/164, 172, 700/195
See application file for complete search history.

(56) References Cited

U.S. PATENT DOCUMENTS

| | | | | |
|---|---|---|---|---|
| 3,498,005 | A * | 3/1970 | Brandt | 451/240 |
| 4,711,035 | A * | 12/1987 | Logan et al. | 33/200 |
| 5,806,198 | A | 9/1998 | Guillermin | |
| 6,071,176 | A * | 6/2000 | Kruis | 451/5 |
| 7,103,441 | B2 * | 9/2006 | Engelfried et al. | 700/161 |
| 7,611,243 | B2 * | 11/2009 | Takeichi | 351/178 |

FOREIGN PATENT DOCUMENTS

| | | | |
|---|---|---|---|
| JP | 8-318458 | A | 12/1996 |
| JP | 2006-239782 | A | 9/2006 |
| JP | 2008-87127 | A | 4/2008 |

* cited by examiner

*Primary Examiner* — Timothy V Eley
(74) *Attorney, Agent, or Firm* — Sughrue Mion, PLLC

(57) ABSTRACT

An eyeglass lens processing apparatus for processing a peripheral edge of an eyeglass lens, includes: a processing unit including a plurality of processing tools that process the peripheral edge of the eyeglass lens held by a lens chuck shaft; a calibrating lens; a mode selector that selects a calibration mode; a memory that stores calibration processing data for processing the calibrating lens to a predetermined shape; a detecting unit that includes a tracing stylus that contacts a surface of the calibrating lens which is processed by the processing unit based on the calibration processing data to detect the shape of the processed calibrating lens in the calibration mode; and a calculating unit that obtain calibration data by comparing a detected result by the detecting unit with the calibration processing data in the calibration mode.

11 Claims, 21 Drawing Sheets

EYEGLASS LENS PROCESSING APPARATUS

BACKGROUND

The disclosure relates to an eyeglass lens processing apparatus preferably suitable for a calibration in processing the peripheral edge of an eyeglass lens by a processing tool.

In the eyeglass lens processing apparatus that processes the peripheral edge of the eyeglass lens by various kinds of processing tools, during the production of the device, during the installation of the device and during the exchange of the various kinds of processing tools, operations need to be carried out for calibrating or correcting the finished size of the lens, an axial angle (AXIS) of the lens and a processing position by the processing tool for each of the processing tools. (See for example, JP-A-2006-239782, JP-A-2008-87127)

SUMMARY

However, in a usual calibrating operation, as in an ordinary processing operation of the lens, after an operator sets a target lens shape and processing conditions for each of calibration items required by each processing tool to process the eyeglass lens, the operator measures the shape of the processed lens by a measuring equipment such as a slide calipers, or the operator visually recognizes the processed shape of the lens by a loupe. Therefore, the calibrating operation in processing the lens by each processing tool requires excessively much labor and time. An operator who is not accustomed to the calibrating operation hardly achieves the calibrating operation accurately and properly. Further, since the lenses are processed one by one for each of the items requiring the calibration, the number of lenses necessary for the calibrating operation is increased.

In a usual calibrating operation of an end position of a drilling tool, after the eyeglass lens is actually drilled, an operator visually recognizes a processed state and carries out an operation for changing adjusting parameters stores in a memory. However, this calibrating operation requires excessively much labor and time. An operator who is not accustomed to the calibrating operation makes an error in operation or a misjudgment, so that the operator hardly calibrate the end position of the drilling tool accurately and properly. Further, when a detecting mechanism for the end position of the drilling tool is newly added, a cost of the device is increased.

By considering the above-described problems of the usual technique, it is a technical object of the present invention to provide an eyeglass lens processing apparatus that can accurately and efficiently carry out a calibration for processing a lens by a processing tool. Further, it is a technical object of the present invention to provide an eyeglass processing device that can suppress the consumption of lenses required for a calibration. Further, it is a technical object of the present invention to provide an eyeglass lens processing apparatus that can automatically calibrate a drilling tool without newly providing an exclusively used detecting mechanism.

In order to solve the above-described problems, the aspects of the disclosure provide the following arrangements.

(1) An eyeglass lens processing apparatus for processing a peripheral edge of an eyeglass lens, the eyeglass lens processing apparatus comprising:

a processing unit including a plurality of processing tools configured to process the peripheral edge of the eyeglass lens held by a lens chuck shaft;

a calibrating lens;

a mode selector configured to select a calibration mode;

a memory configured to store calibration processing data for processing the calibrating lens to a predetermined shape;

a detecting unit including a tracing stylus configured to contact a surface of the calibrating lens which is processed by the processing unit based on the calibration processing data to detect the shape of the processed calibrating lens in the calibration mode; and a calculating unit configured to obtain calibration data by comparing a detected result by the detecting unit with the calibration processing data in the calibration mode.

(2) The eyeglass lens processing apparatus according to (1), wherein the calibrating lens includes a plane plate exclusively used for calibration.

(3) The eyeglass lens processing apparatus according to (2), wherein the calibrating lens has a circular shape or a square shape.

(4) The eyeglass lens processing apparatus according to (2), wherein the processing unit includes a plurality of processing shafts to which the processing tools are respectively attached, the mode selector can select one of a collective calibration mode and a specific unit calibration mode for specific processing shafts, and in the collective calibration mode, calibration items for the processing tools respectively attached to the processing shafts are carried out in a predetermined order.

(5) The eyeglass lens processing apparatus according to (4), wherein the calibration items of the collective calibration mode includes a calibration item for a processing shaft to which a bevel-finishing tool is attached, a calibration item for a processing shaft to which a flat-finishing tool is attached and a calibration item for a processing shaft to which a chamfering tool is attached.

(6) The eyeglass lens processing apparatus according to (1), wherein the calibration processing data includes first calibration processing data of a first calibration item and second calibration processing data of a second calibration item, and a diameter of the calibrating lens processed based on the second calibration processing data is smaller than a diameter of the calibrating lens processed based on the first calibration processing data, so that the calibration data for the first calibration item and the second calibration item can be obtained by using the single calibrating lens.

(7) The eyeglass lens processing apparatus according to (1), wherein the tracing stylus include a first tracing stylus portion configured to contact the peripheral edge of the processed calibrating lens, a second tracing stylus portion having a V groove configured to contact a bevel formed in the peripheral edge of the processed calibrating lens and a third tracing stylus portion having a protruding part configured to inserted into a groove formed in the peripheral edge of the processed calibrating lens.

(8) The eyeglass lens processing apparatus according to (1), wherein the tracing stylus includes a tracing stylus portion configured to contact the peripheral edge of the calibrating lens, and the tracing stylus portion is used as a tracing stylus for measuring an outside diameter of the eyeglasses leans which is not processed when a processing mode for processing the eyeglass lens is selected by the mode selector.

(9) The eyeglass lens processing apparatus according to (1), wherein the tracing stylus includes tracing stylus portions contact a front surface and a rear surface of the calibrating lens, respectively, and the tracing stylus portions are used as tracing styluses for detecting edge positions of the eyeglass lens to be processed by the processing unit when a processing mode for processing the eyeglass lens is selected by the mode selector.

(10) The eyeglass lens processing apparatus according to (1), wherein the processing unit includes a drilling unit having a drilling tool for drilling the eyeglass lens held by the lens chuck shaft, the detecting unit includes a lens edge position detecting unit including a tracing stylus portion configured to contact a refracting surface of the eyeglass lens and a sensor for detecting an axial movement of a holding member for holding the tracing stylus portion and detects the edge position of the eyeglass lens based on an output signal from the sensor, the lens edge position detecting unit detects an end position of the drilling tool, and the eyeglass lens processing apparatus further comprises a drilling tool calibration control unit configured to obtain calibration data for the end position of the drilling tool based on the output signal from the sensor when a predetermined contact part of the holding member contacts the end of the drilling tool in the calibration mode.

(11) The eyeglass lens processing apparatus according to (10), wherein the drilling unit includes a tilting unit configured to tilt the drilling tool relative to the lens chuck shaft so that a center of the tilt of the drilling tool is located on an axis of the movement of the contact part which is moved in parallel with the lens chuck shaft, and the drilling tool calibration control unit controls the tilting unit during the calibration mode of the drilling tool to locate the end direction of the drilling toll in the axial direction of the movement of the contact part.

According to the aspects of the disclosure, a calibration for processing the lens by the processing tool can be accurately and efficiently carried out. Further, the consumption of lenses required for a calibrating operation can be suppressed. Further, a drilling tool can be automatically calibrated without newly providing an exclusively used detecting mechanism.

DETAILED DESCRIPTION OF EXEMPLARY EMBODIMENTS

Figure 1:
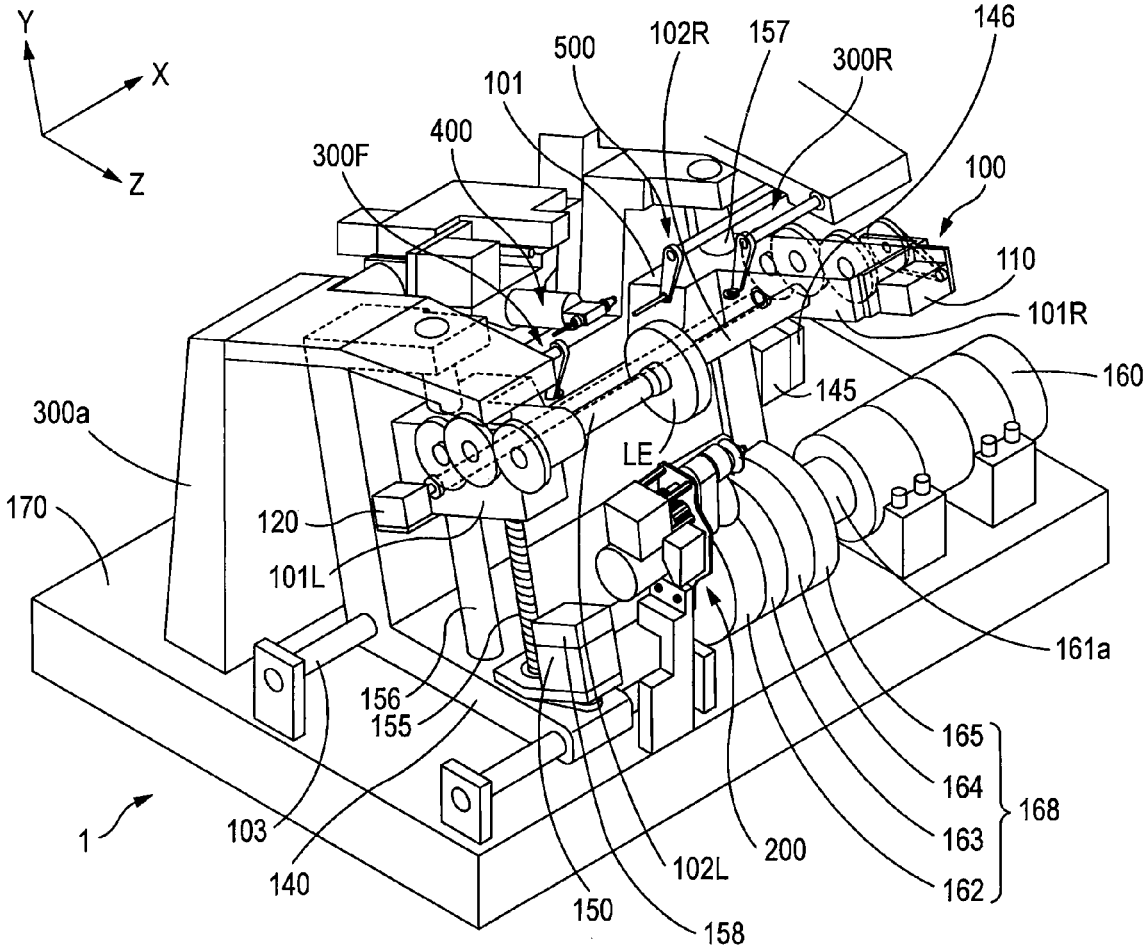
FIG. 1 is a schematic structural diagram of an eyeglass lens processing apparatus.

An exemplary embodiment of the disclosure will be described by referring to the drawings. FIG. 1 is a schematic structural diagram of an eyeglass lens processing apparatus according to the exemplary embodiment.

A carriage 101 that holds a pair of lens chuck shafts 102L and 102R L so as to freely rotate is mounted on a base 170 of a processing device 1. A peripheral edge of an eyeglass lens LE held between the chuck shafts 102L and 102R is pressed to and processed by grindstones respectively included in a group of grindstones 168 as processing tools attached coaxially to a spindle (a rotating shaft of a processing tool) 161*a*.

Figure 2:
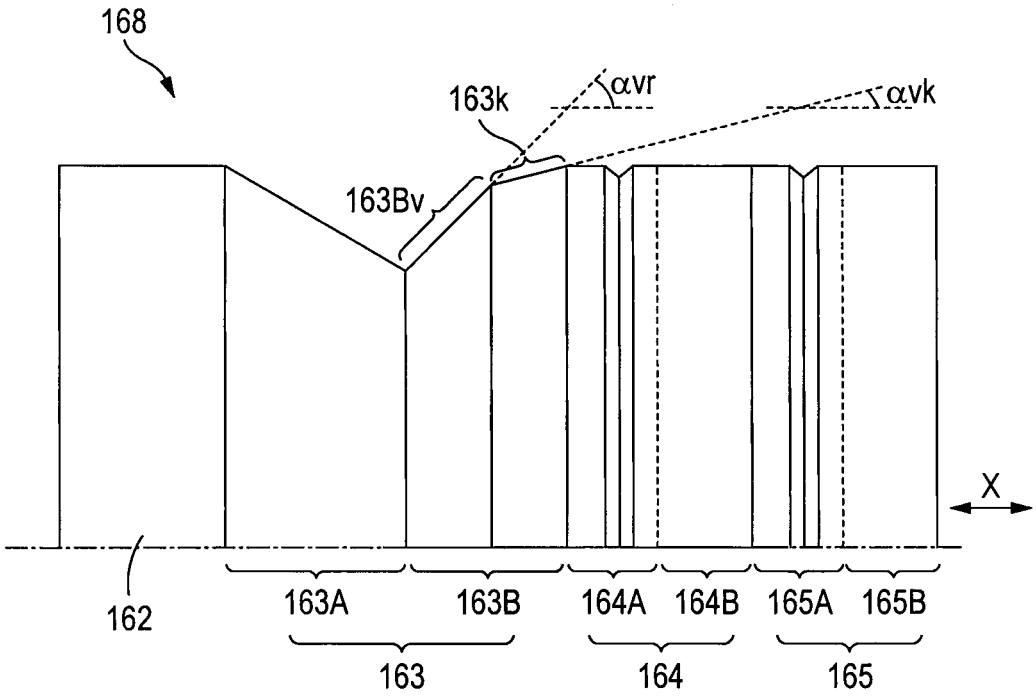
FIG. 2 is a structural diagram of grindstones attached coaxially with a spindle.

As shown in FIG. 2, the group of grindstones 168 includes a rough grindstone 162 for plastic, a finishing grindstone 163 having a front beveling surface for forming a front bevel and a rear beveling surface for forming a rear bevel of a high curve lens, a finishing grindstone 164 having a V groove for forming a bevel used for a low curve lens and a flat-finishing surface and a polishing grindstone 165 having a V groove for forming a bevel and a flat-finishing surface. The grindstone 163 as a beveling tool for the high curve lens includes a grindstone 163A having the front beveling surface and a grindstone 163B for processing the rear bevel. Further, the grindstone 163B for processing the rear bevel includes the rear beveling surface 163Bv for forming the rear bevel and a rear bevel foot processing surface 163Bk for forming a rear bevel foot connected to the rear bevel, which are integrally formed. A tilt of the rear bevel foot processing surface 163Bk relative to an X-axis direction is set to be smaller than a tilt angle of the rear bevel foot processing surface 163Bk relative to the X-axis direction and larger than 0°. The finishing grindstone 164 includes a bevel grindstone 164A having the V groove for forming the bevel and a flat-finishing grindstone 164B having the flat-finishing surface. The grindstone 164A is formed integrally with the grindstone 164B. Similarly, the polishing grindstone 165 includes a polishing grindstone 165A having the V groove for forming the bevel and a polishing grindstone 165B having the flat-finishing surface for flat-finishing. The polishing grindstone 165A is formed integrally with the polishing grindstone 165B. The grindstone spindle 161*a* is rotated by a motor 160. A grindstone rotating unit is formed by the above-described members. As a rough processing tool and a finishing tool, a cutter may be used.

The lens chuck shaft 102R is moved toward the lens chuck shaft 102L by a motor 110 attached to a right arm 101R of the carriage 101. Further, the lens chuck shafts 102R and 102L are synchronously rotated by a motor 120 attached to a left arm 101L through a rotation transmitting mechanism such as a gear. An encoder 120*a* for detecting rotating angles of the lens chuck shafts 102R and 102L is attached to a rotating shaft of the motor 120. The above-described members form a chuck shaft rotating unit.

The carriage 101 is mounted on a support base 140 movable along shafts 103 and 104 extending in the X-axis direction and is linearly moved in the X-axis direction (an axial direction of the chuck shaft) according to the rotation of a motor 145. An encoder 146 for detecting a moving position of the chuck shaft in the X-axis direction is attached to a rotating shaft of the motor 145. These members form an X-axis direction moving unit. Further, shafts 156 and 157 which extend in a Y-axis direction (a direction in which an axial distance between the chuck shafts 102L and 102R and the grindstone spindle 161*a* is varied) are fixed to the support base 140. The carriage 101 is mounted on the support base 140 so as to be movable in the Y-axis direction along the shafts 156 and 157. A Y-axis moving motor 150 is fixed to the support base 140. The rotation of the motor 150 is transmitted to a ball screw 155 extending in the Y-axis direction. The carriage 101 is moved in the Y-axis direction by the rotation of the ball screw 155. an encoder 158 for detecting a moving position of the chuck shaft in the Y-axis direction is attached to a rotating shaft of the motor 150. The above-described members form a Y-axis direction moving unit (an axial distance varying unit).

Figure 3:
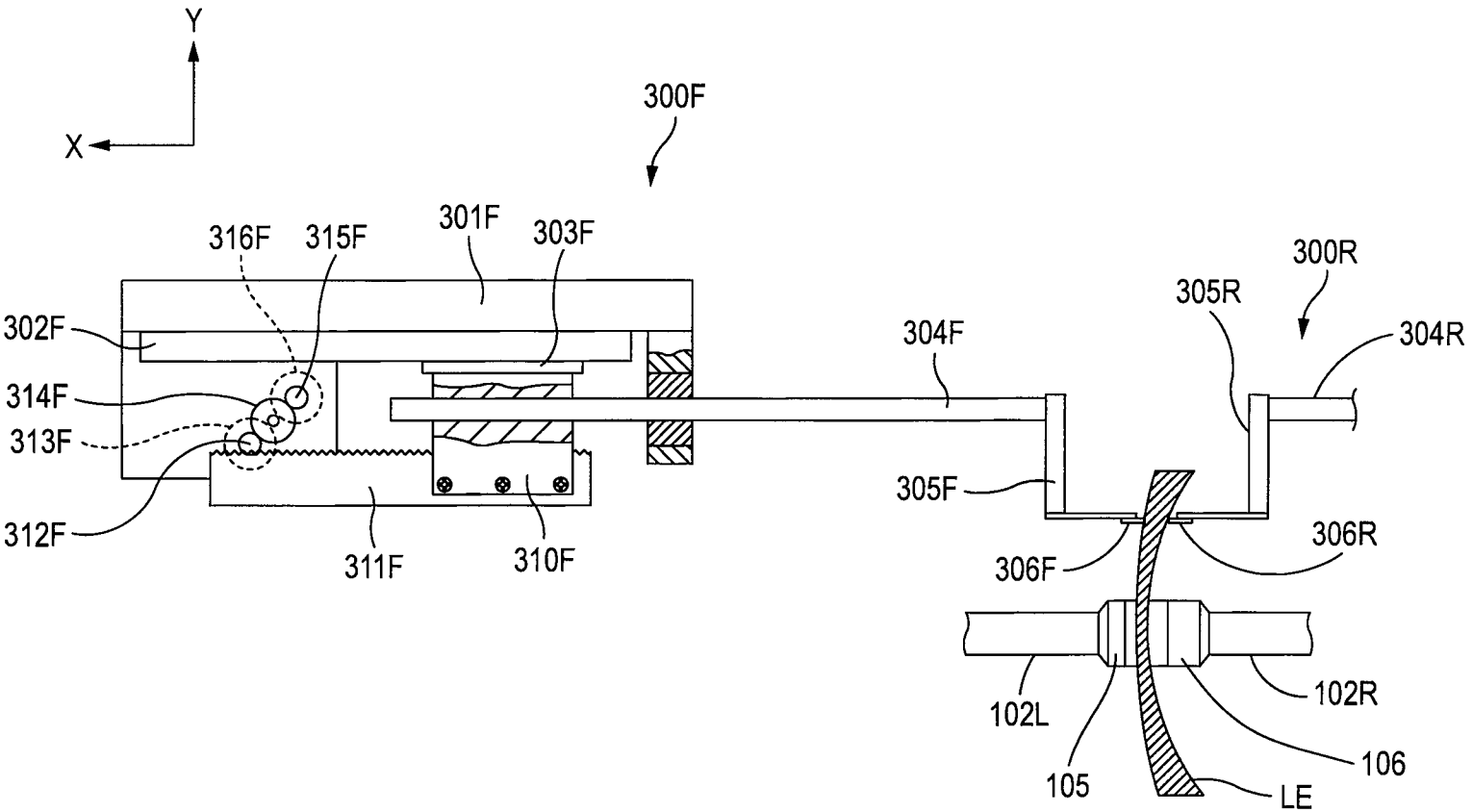
FIG. 3 is a structural diagram of a lens edge position detecting unit

In FIG. 1, lens edge position detecting units 300F and 300R are provided in right and left parts in an upper part of the carriage 101. FIG. 3 is a schematic structural view of the detecting unit 300F for detecting an edge position of a front surface of the lens (the edge position of the front surface side of the target lens shaped lens).

A support base 301F is fixed on a block 300*a* fixed to the base 170. A tracing stylus arm 304F is held on the support base 301F so as to freely slide in the X-axis direction through a slide base 310F. An L-shaped hand 305F is fixed to an end part of the tracing stylus arm 304F. A tracing stylus 306F is fixed to an end of the hand 305F. The tracing stylus 306F contacts the front surface of the lens LE. A rack 311F is fixed to a lower end part of the slide base 310. The rack 311F is engaged with a pinion 312F of an encoder 313F fixed to the support base 301F side. Further, the rotation of a motor 316F is transmitted to the rack 311F through a rotation transmitting mechanism such as gears 315F and 314F. Thus, the slide base 310F is moved in the X-axis direction. When the motor 316F is driven, the tracing stylus 306F located at a retracted position is moved to the lens LE side and a measuring pressure is applied to press the tracing stylus 306F to the lens LE. When the position of the front surface of the lens LE is detected, the lens LE is rotated according to a target lens shape, the lens chuck shafts 102L and 102R are moved in the Y-axis direction and the edge position of the front surface of the lens (the edge position of the front surface side of the target lens shaped lens) in the X-axis direction is detected by the encoder 313F.

Since the structure of the detecting unit 300R for detecting an edge position of a rear surface of the lens is symmetrical to that of the detecting unit 300F, ends "F" of reference numerals attached to the components of the detecting unit 300F shown in FIG. 3 are respectively replaced by "R" and an explanation of thereof will be omitted.

Figure 4:
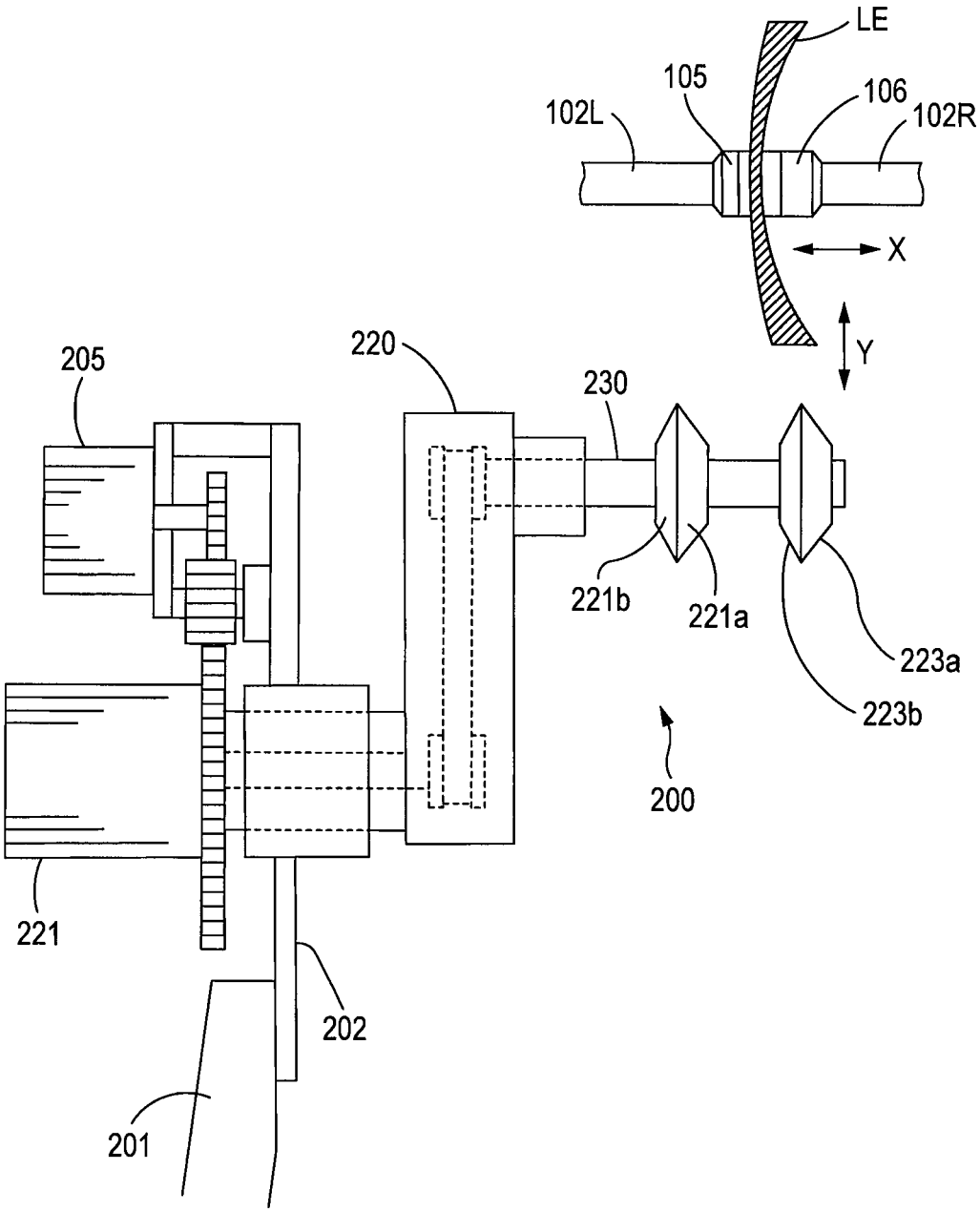
FIG. 4 is a structural diagram of a chamfering unit.

In FIG. 1, a chamfering unit 200 is arranged in a front side of a device main body. FIG. 4 is a structural diagram of the chamfering unit 200. A chamfering grindstone 221*a* for the front surface of the lens, a chamfering grindstone 221*b* for the rear surface of the lens, a chamfer-polishing grindstone 223*a* for the front surface of the lens and a chamfer-polishing grindstone 223*b* for the rear surface of the lens as chamfering tools are coaxially attached to a grindstone rotating shaft (a rotating shaft of a processing tool) 230 attached to an arm 220 so as to freely rotate. The rotating shaft 230 is rotated by a motor 221 through a rotation transmitting mechanism such as a belt in the arm 220. The motor 221 is fixed to a fixing plate 202 extending from a support base block 201. Further, a motor 205 for rotating the arm is fixed to the fixing plate 202. When the motor 205 is rotated, the rotating shaft 230 is moved to a processing position shown in FIG. 2 from a retracted position. The processing position of the rotating shaft 230 is located at a position on a plane (a plane of the X-axis and the Y-axis) where both the rotating shafts of the lens chuck shafts 102R and 102L and the grindstone spindle 161*a* are located between the lens chuck shafts 102R and 102L and the grindstone spindle 161*a*. The lens LE is moved in the Y-axis direction by the motor 150 and the lens LE is moved in the X-axis direction by the motor 145 to chamfer the peripheral edge of the lens similarly to a processing work of the peripheral edge of the lens by the grindstones 168.

Figure 5:
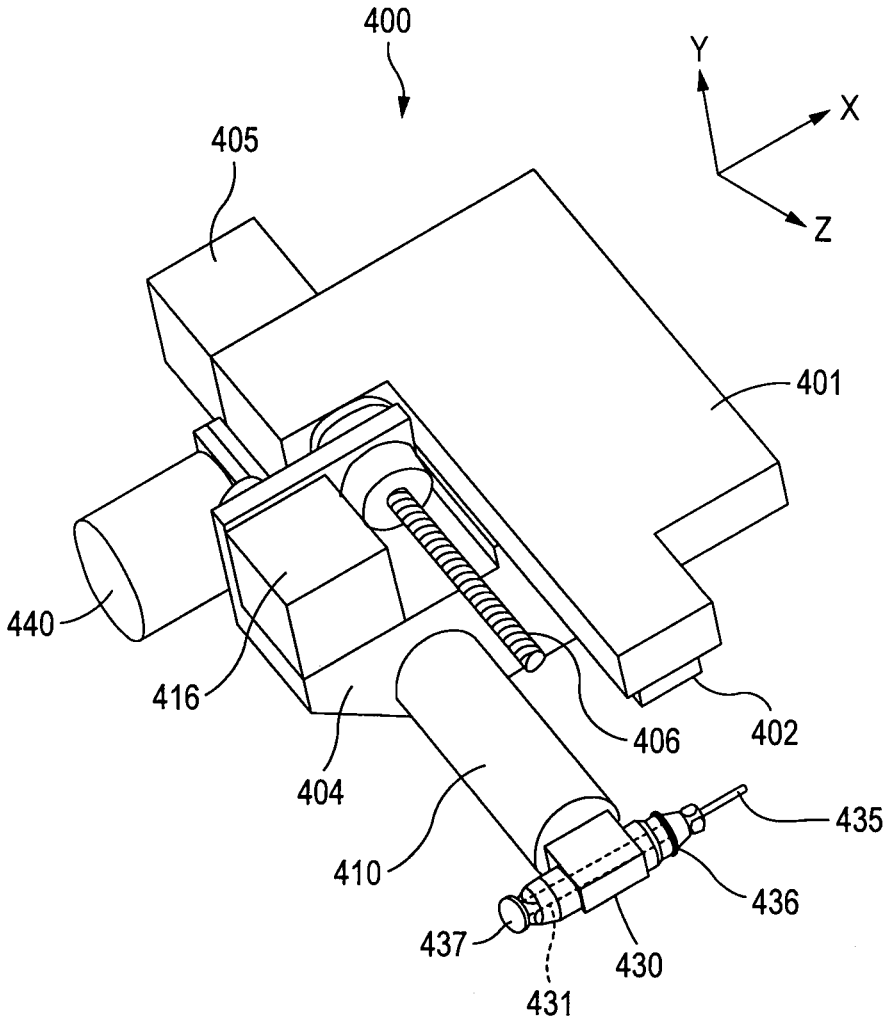
FIG. 5 is a structural diagram of a drilling and grooving unit.

In a rear part of the carriage part 101, a drilling and grooving unit 400 is arranged. FIG. 5 is a schematic structural diagram of the unit 400. A fixing plate 401 as a base of the unit 400 is fixed to the block 300*a* provided upright on the base 170 shown in FIG. 1. A rail 402 extending in a Z-axis direction (a direction orthogonal to the X and Y directions) is fixed to the fixing plate 410 and a moving support base 404 is attached along the rail 402 so as to freely slide. The moving support base 404 is moved in the Z-axis direction by rotating a ball screw 406 by a motor 405. A rotating support base 410 is held so as to freely rotate to the moving support base 404. The rotating support base 410 is rotated on an axis by a motor 416 through a rotation transmitting mechanism.

A rotating part 430 is attached to an end part of the rotating support base 410. a rotating shaft 431 orthogonal to the axial direction of the rotating support base 410 is held to the rotating part 430 so as to freely rotate. an end mill 435 as a drilling tool and a cutter (or a grindstone) 436 as a grooving tool are coaxially attached to one end of the rotating shaft 431. A step bevel grindstone 437 as a processing tool for modifying or processing a bevel tilt surface or a bevel foot is coaxially attached to the other end of the rotating shaft 431. The rotating shaft 431 is rotated by a motor 440 attached to the moving support base 404 through a rotation transmitting mechanism arranged in the rotating part 430 and the rotating support base 410.

Figure 6A:
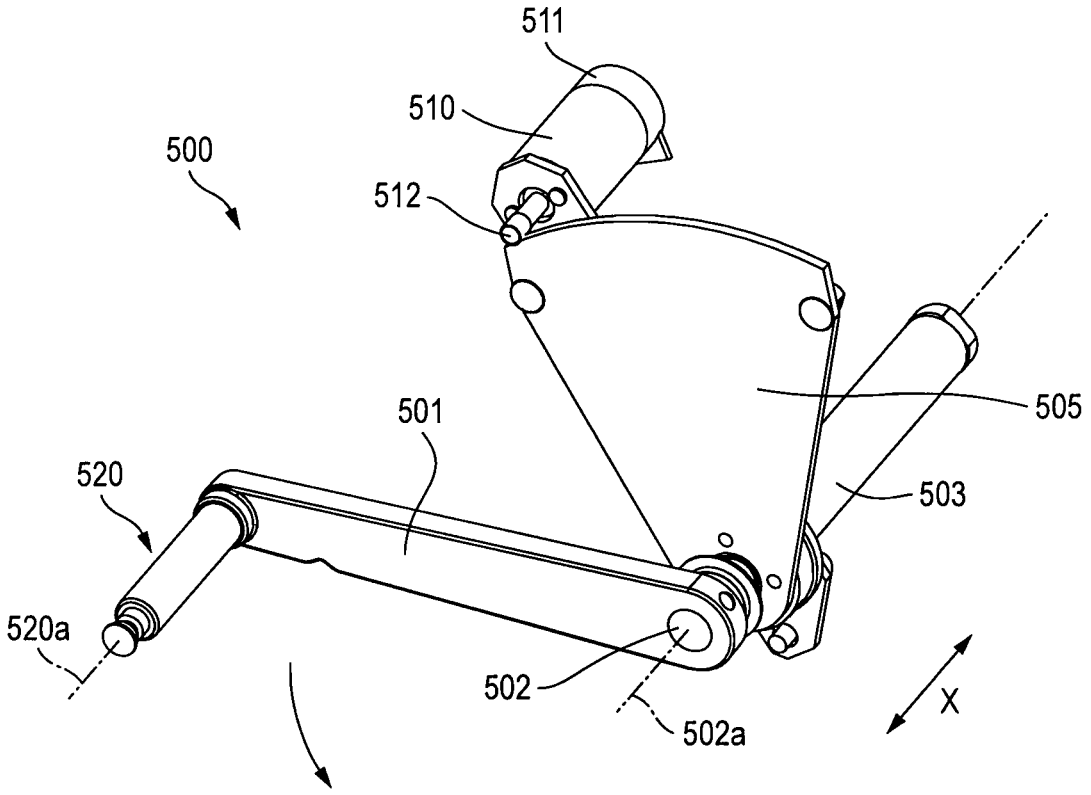
FIG. 6A is a schematic structural diagram of a lens outside diameter detecting unit.
Figure 6B:
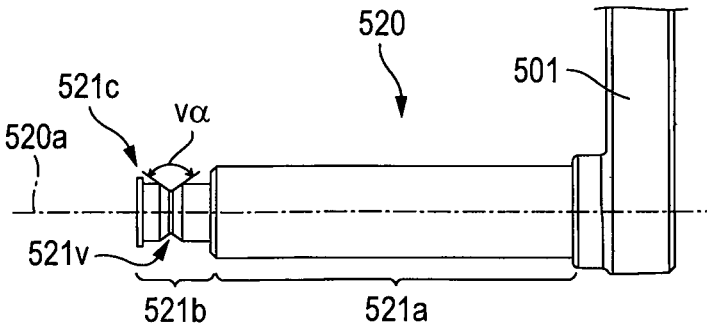
FIG. 6B is a front view of a tracing stylus of the lens outside diameter detecting unit.

In FIG. 1, in a rear part of an upper part of the lens chuck shaft 102R side, a lens outside diameter detecting unit 500 is arranged. FIG. 6A is a schematic structural diagram of the lens outside diameter detecting unit 500. FIG. 6B is a front view of a tracing stylus 520 provided in the unit 500.

The cylindrical tracing stylus 520 which contacts the edge of the lens LE is fixed to one end of an arm 501 and a rotating shaft 502 is fixed to the other end of the arm 501. A central axis 520*a* of the tracing stylus 520 and a central axis 502*a* of the rotating shaft 502 are arranged with a positional relation parallel to the lens chuck shafts 102L and 102R (the X-axis direction). The rotating shaft 502 is held by a holding part 503 so as to freely rotate on the central axis 502*a*. The holding part 503 is fixed to the block 300*a* shown in FIG. 1. Further, a sector shaped gear 505 is fixed to the rotating shaft 502 and the gear 505 is rotated by a motor 510. A pinion gear 512 engaged with the gear 505 is attached to a rotating shaft of the motor 510. Further, an encoder 511 as a detector is attached to the rotating shaft of the motor 510.

The tracing stylus 520 includes a cylindrical part 521*a* which contacts a peripheral edge of the lens LE when an outside diameter size of the lens LE is measured, a cylindrical part 521*b* with a small diameter including a V groove 521*v* used when the position of the bevel formed in the peripheral edge of the lens LE in the X-axis direction is measured and a protruding part 521*c* used when the position of a groove formed in the peripheral edge of the lens is measured. An opening angle vα of the V groove 521*v* is formed to be the same as an opening angle of the V groove for forming the bevel provided in the finishing grindstone 164A or wider than it. Further, the depth vd of the V groove 521*v* is formed to be smaller than that of the V groove of the finishing grindstone 164A. For instance, while the depth of the V groove of the finishing grindstone 164A is 1.0 mm, the depth vd of the V groove 521*v* is 0.5 mm. Thus, the bevel formed in the lens LE by the V groove of the finishing grindstone 164A is inserted into the center of the V groove 521*v* without interfering with other part.

Figure 7:
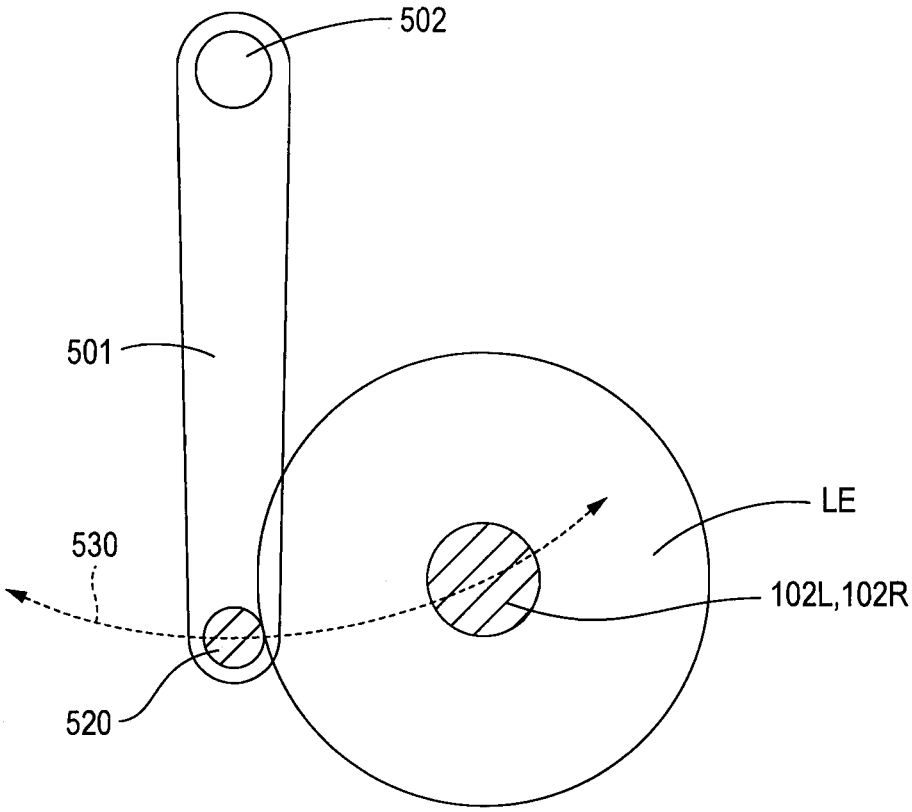
FIG. 7 is an explanatory view of a measurement of a lens outside diameter by the lens outside diameter detecting unit.

The lens outside diameter detecting unit 500 is used to detect whether or not an outside diameter of the lens LE to be processed has a sufficient size with respect to the target lens shape in processing the peripheral edge of an ordinary eyeglass lens LE. When the outside diameter of the lens LE is measured, as shown in FIG. 7, the lens chuck shafts 102L and 102R are moved to predetermined measuring positions (on a moving path 530 of the central axis 520*a* of the tracing stylus 520 rotated on the rotating shaft 502). When the arm 501 is rotated in a direction (the Z-axis direction) orthogonal to the X-axis and the Y-axis of the device 1 by the motor 510, the tracing stylus 520 located at a retracted position is moved toward the lens LE, and the cylindrical part 521*a* of the tracing stylus 520 contacts the edge (the peripheral edge) of the lens LE. Further, a predetermined measuring pressure is applied to the tracing stylus 520 by the motor 510. Then, when the chuck shafts 102L and 102R are rotated once, the lens LE is also rotated once. The lens LE is rotated for each of steps of predetermined minute angles. The movement of the tracing stylus 520 at this time is detected by the encoder 511 to measure the outside diameter of the lens LE on the chuck shafts (a radius of the lens LE on the chuck shafts).

The lens outside diameter detecting unit 500 may be formed by a mechanism linearly moved in the direction (the Z-axis direction) orthogonal to the X-axis and the Y-axis of the device 1 as well as by a rotating mechanism of the arm 501 as described above.

Figure 8:
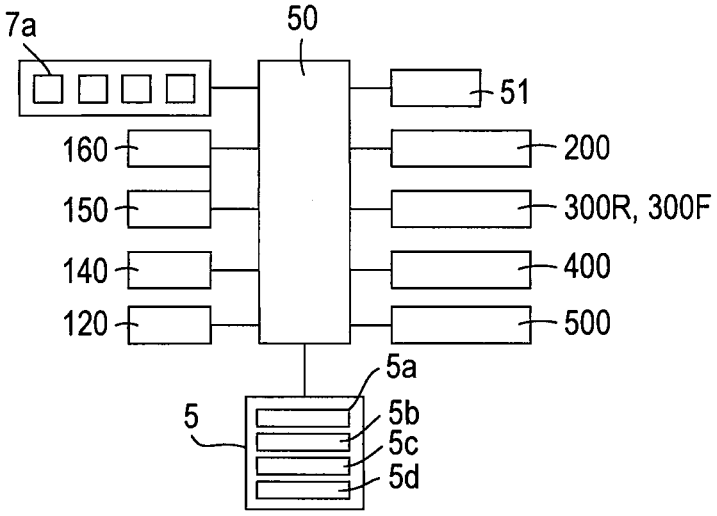
FIG. 8 is a control block diagram of the eyeglass lens processing apparatus.

FIG. 8 is a control block diagram of the eyeglass lens processing apparatus. The motors 120, 145 and 150 for rotating and moving the lens chuck shafts, the motor 160 for rotating the group of grindstones 168, the lens edge position detecting units 300F and 300R, the chamfering unit 200, the drilling and grooving unit 400 and the lens outside diameter detecting unit 500 are connected to a control unit 50. Further, a display 5 having a touch panel function for inputting data of processing conditions, a switch part 7 provided with a processing start switch, a memory 51 and an eyeglass frame form measuring device (an illustration is omitted) are connected to the control unit 50. A screen for selecting a calibration mode is displayed on the display 5. A switch 7*a* for executing the calibration mode selected on the display 5 is provided at the switch part 7. Various kinds of calibrating target lens shapes (calibration processing data for processing the calibrating lens to a predetermined shape) and programs of various kinds of calibration modes are stored in the memory 51.

Now, calibrating operations of various kinds of processing works by the processing tools of the device 1 (the finishing grindstone 164 for the low curve lens, the finishing grindstone 163 for the high curve lens, the chamfering grindstones 221*a* and 221*b* of the chamfering unit 200, the grooving cutter 436 and the drilling end mill 435 of the drilling and grooving unit 400, or the like) will be respectively described below. In the present device, basically, the control unit 50 controls the motors respectively for moving and rotating the chuck shafts according to a predetermined calibration program to process the lens by the processing tools respectively, then, drives the lens outside diameter detecting unit 500 and the lens edge position detecting units 300F and 300R to measure the shape of the processed or finished lens and thus obtains various kinds of calibration data.

For the calibration mode, during a stage of producing the device 1 and during a stage of installing the device 1, a collective calibration mode in which a calibration by the various kinds of processing tools is collectively carried out and a specific unit calibration mode in which a calibration is carried out for each of the units when the processing tools of the grindstones of the spindle 161*a*, the chamfering unit 200 and the drilling and grooving unit 400 are respectively exchanged can be selected by switches 5*a*, 5*b*, 5*c* and 5*d* on the calibration mode selecting screen displayed on the display 5.

Initially, a case that the collective calibration mode is selected by the switch 5*a* will be described below. An operator prepares a calibrating lens and causes the calibrating lens to be held by the chuck shafts 102L and 102R as in an ordinary lens processing work. The calibrating lens may be a lens having a curved shape used as an eyeglass lens. However, in the calibration mode described below, in order to reduce the number of the lenses as much as possible, achieve various kinds of calibrating operations and improve a calibrating accuracy, a lens (refer it to as a lens LC, hereinafter) exclusively used for a calibration as described below is used. As the calibrating lens LC, for instance, a regular square shaped flat plate that has thickness Lt of 2.5 to 3.0 mm and one side of 55 mm or larger is used. Otherwise, a circular flat plate whose diameter is 75 mm or larger is used. A material of the lens LC is preferably plastic similarly to an ordinary eyeglass lens.

After the lens LC is prepared, when the start switch 7*a* is pressed, the control unit 50 processes or finishes the lens LC according to below-described gradual processing steps and obtains the calibration data of calibration items respectively.

<First Processing Step>

Figure 9:
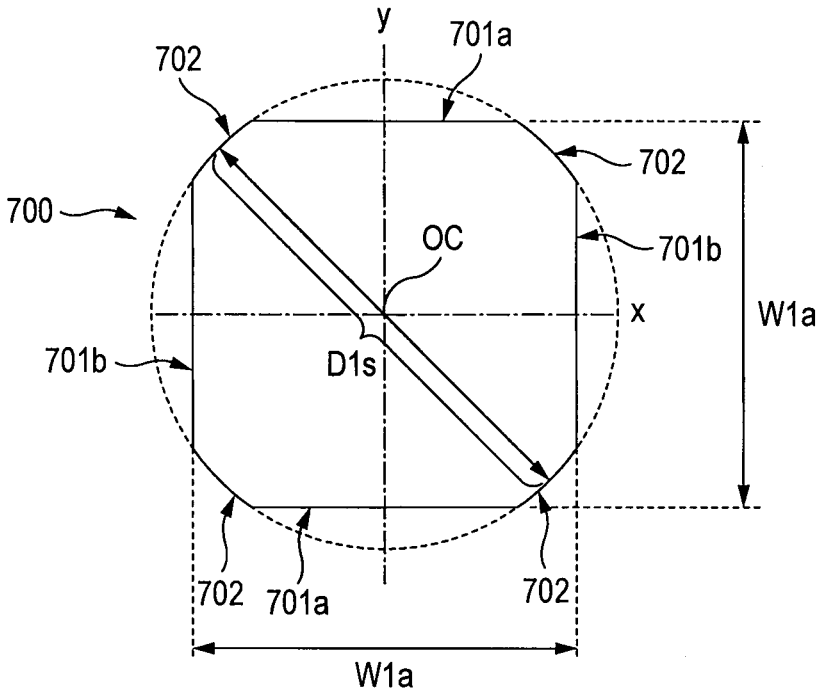
FIG. 9 is a diagram of a calibrating target lens shape in a first processing step.

A first processing step is a processing step for calibrating a beveling size by a grindstone for a low curve bevel, an axial angle (AXIS) of a beveling work and a bevel position (a position of a bevel apex in the X-axis direction). FIG. 9 shows a calibrating target lens shape 700 in the first processing step and the target lens shape 700 is stored in the memory 51. The target lens shape 700 is set to a shape obtained in such a way that four corners of a square shape having one sides of size W1*a*=51 mm which are parallel to an x-axis and a y-axis provided for the convenience of managing the target lens shape with a center OC as a center of a chuck (a center of a processing work) taken as a reference are cut by a diameter D1*s*=62 mm having the center OC as a central part, and includes linear areas 701*a* parallel to the x-axis, linear areas 701*b* parallel to the y-axis and partly circular areas 702 with the center OC as a reference. The x-axis and the y-axis of the target lens shape are different from the X-axis and the Y-axis of the device 1 and are axes provided for the convenience of managing the target lens shape and having a predetermined relation to the rotating angle θ of the chuck shafts. For instance, an x-axis direction is set to the rotating angle θ=0° of the chuck shafts 102L and 102R.

The control unit 50 initially operates the lens edge position detecting units 300F and 300R as in the processing work of the ordinary lens LE to obtain the edge position of the front surface and the edge position of the rear surface of the lens LC held by the chuck shafts 102L and 102R based on the target lens shape 700. Beveling data for forming the bevel in the peripheral edge of the lens LC is calculated according to the edge positions of the front surface and the rear surface. Here, a path of the bevel apex is supposed to be arranged at a position obtained by dividing an edge thickness in the ratio of 5:5. The control unit 50 controls the motors respectively for moving the chuck shafts 102L and 102R in the X-axis direction and the Y-axis direction and the motor for rotating the chuck shafts 102L and 102R to roughly process the lens LC by the rough grindstone 162 according to the target lens shape 700 and then bevel-finish the lens LC by the V groove of the finishing grindstone 164 A according to the beveling data.

Figure 10:
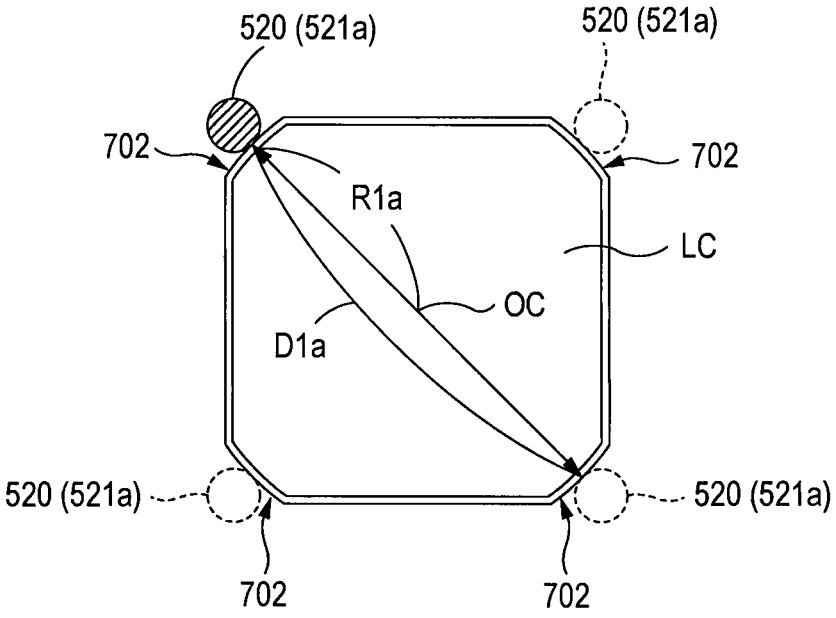
FIG. 10 is an explanatory view of a measurement of an outside diameter in a bevel-finishing work.

After the bevel finishing or processing work is finished, the control unit 50 measures the outside diameter of the bevel-finished lens LC by the lens outside diameter detecting unit 500. The control unit 50 drives the motor 150 of the Y-axis to locate the chuck shafts 102L and 102R at a predetermined measuring position (see FIG. 7) for measuring the outside diameter, and drives the motor 145 of the X-axis to move the lens LC to a position where the cylindrical part 521*a* of the tracing stylus 520 contacts the apex of the processed or finished bevel. After that, the control unit drives the motor 510 to control the tracing stylus 520 (the cylindrical part 521*a*) located at a retracted position to contact the bevel of the lens LC and rotate the lens LC. Thus, as shown in FIG. 10, the outside diameter (a radius) R1*a* of the circular areas 702 in four directions is measured by the encoder 511. In a measurement of the size of the circular area 702, the radius R1*a* may be obtained only in one part of a predetermined angle (for instance, 135°) in one circular area 702. However, preferably, the radius R1*a* may be obtained for the areas 702 located in diagonal lines with respect to the center OC as a central part or all the areas 702 in the four directions. The radiuses R1*a* located in the diagonal lines are respectively obtained so that the outside diameter of the bevel is obtained as a diameter D1*a*. The control unit 50 compares the diameter D1*a* of the outside diameter of the bevel of the processed or finished lens with the diameter D1*s* of the target lens shape 700 before a calibration (or the radius R1*a* of the processed or finished lens with the radius of the target lens shape 700) to obtain corrected data (calibration data) of the outside diameter size of the bevel.

Figure 11:
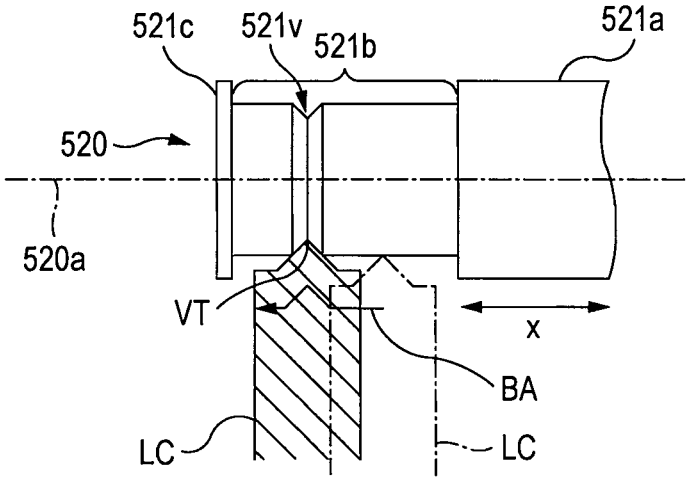
FIG. 11 is an explanatory view of a measurement of a bevel position.

Then, the control unit is shifted to a measuring process of the bevel position. The control unit 50 controls the cylindrical part 521*b* with the small diameter formed in the tracing stylus 520 to contact the bevel apex VT of the circular area 702 as shown in FIG. 11, and drives the motor 145 of the X-axis to move the lens LC leftward as shown by an arrow mark BA in FIG. 11. According to this movement, when the bevel apex VT enters the V groove 521*v* formed in the cylindrical part 521*b*, a distance from the center of the chuck measured by the encoder 511 of the lens outside diameter detecting unit 500 is varied. When the distance measured by the encoder 511 is minimum, a position of the bevel apex in the X-axis direction is obtained. The control unit 50 reads moving data in the X-axis direction at this time from the encoder 146 to obtain the bevel position (the position in the X-axis direction). The bevel position before a calibration is compared with the measured bevel position to obtain corrected data (calibration data) of the bevel position.

Then, the control unit is shifted to a measuring process of the axial angle (an AXIS deviation) of the beveling work. After the control unit 50 rotates the lens LC so that the y-axis direction (or the x-axis direction) of the target lens shape 700 corresponds to the Y-axis direction of the device 1, the control unit 50 controls the cylindrical part 521*a* of the tracing stylus 520 to contact the linear area 701*b* (or 701*a*) of the bevel part processed in the lens LC. Under a state that the tracing stylus 520 contacts the linear area 701*b*, the control unit drives the motor 150 of the Y-axis to move the chuck shafts 102L and 102R (the lens LC) by a predetermined distance ΔY (for instance, 10 mm) in the Y-axis direction as shown by an arrow mark BB. Variation information of the tracing stylus 520 at this time is obtained from the output of the encoder 511. While the lens LC is moved by the distance ΔY, when there is no variation in the tracing stylus 520, the linear area 701*b* is parallel to the Y-axis, so that the axial angle (AXIS) in the beveling work of the lens LC does not need to be corrected. However, when there is a variation in the tracing stylus 520, corrected data of the axial angle is obtained according to a variation amount thereof. When there is a variation of Δd in the tracing stylus 520 while the lens LC is moved by the distance ΔY, assuming that a correction amount of the axial angle of the beveling work is Δθ, the correction amount (Δθ) is obtained by tan (Δθ)=Δd/ΔY. A correcting diction of (+/−) of Δθ is determined by the direction +/− of the variation amount Δd.

The measuring process of the axial angle of the beveling work as described above is carried out in four parts in total including the two parallel linear areas 702*b* and the two parallel linear areas 701*a* and the calibration data of the axial angle of the beveling work may be obtained as an average value thereof.

<Second Processing Step>

Figure 13:
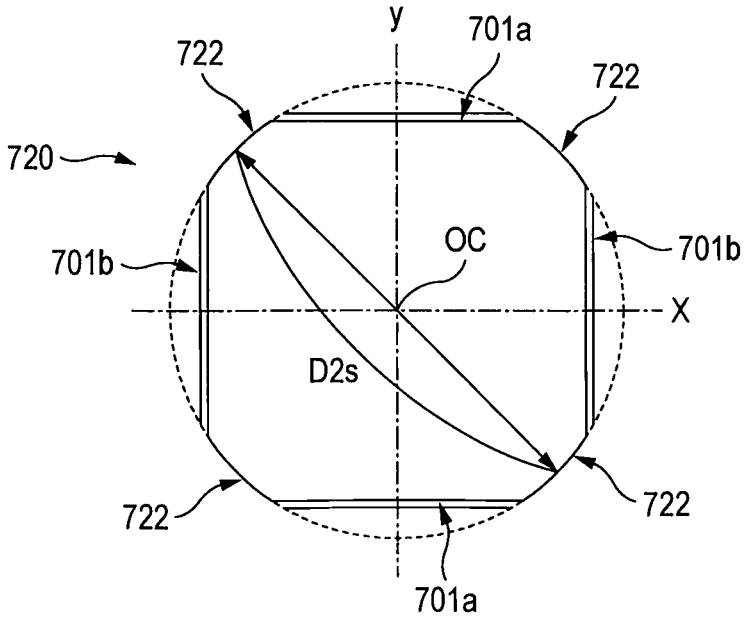
FIG. 13 is a diagram of a target lens shape in a second processing step.

In a second processing step subsequent to the first processing step, a processing work is carried out for calibrating a flat-finishing size formed by the flat-finishing surface provide in the finishing grindstone 164B and the depth and the position of a groove formed by the cutter 436. FIG. 13 is a diagram of a target lens shape 720 in the second processing step. In the target lens shape 720, a diameter D2*s* of circular areas 722 is set to a diameter (60 mm) smaller than the diameter D1*s* of the circular areas 702 of the target lens shape 700 so as to cut and flat-finish the bevels of the circular areas 702 of the lens processed in the target lens shape 700.

The control unit 50 calls the target lens shape 720 from the memory 51 to flat-finish the circular areas 722 of four parts by the flat-finishing surface of the finishing grindstone 164B according to the target lens shape 720. Subsequently, the flat-finished parts of the circular areas 722 are grooved by the cutter 436. A position of a grooving work in the direction of an edge (the X-axis direction) is set as a position where an edge thickness is divided in the ratio of 5:5 similarly to the path of the bevel. Further, the depth of the groove is set to 0.3 mm smaller than the height (0.5 mm) of the protruding part 521*c* of the tracing stylus 520. When the eyeglass lens having a curved surface shape is used as the lens LC, also in the processing work of the second processing step, the edge positions of the front surface and the rear surface of the lens are measured by the lens edge position detecting units 300F and 300R based on the target lens shape 720. When an amount of the processing work of the peripheral edge is large, the lens which is already processed in the first processing step may be roughly finished by the rough grindstone 162 before the flat-finishing work by the finishing grindstone 164B.

After the flat-finishing work and the grooving work of the circular areas 722 are finished, the control unit operates again the lens outside diameter detecting unit 500. Like the measurement of the outside diameter in the bevel-finished lens shown in FIG. 10, the control unit 50 controls the cylindrical part 521*a* of the tracing stylus 520 to contact the flat-finished parts of the circular areas 722 of the four parts (an illustration is omitted) to obtain the outside diameter (a radius) R2*a* of the circular areas 722 in the four directions with respect to the center of the chuck (OC) according to an output from the encoder 511. Then, the control unit 50 compares the diameter D2*a* of the flat-finished parts of the processed lens with the diameter D2*s* of the target lens shape 720 before a calibration (or the radius R2*a* of the processed lens is compared with the radius D2*s*/2 of the target lens shape) to obtain corrected data (calibration data) of the outside diameter size of the flat-finishing work.

Figure 14:
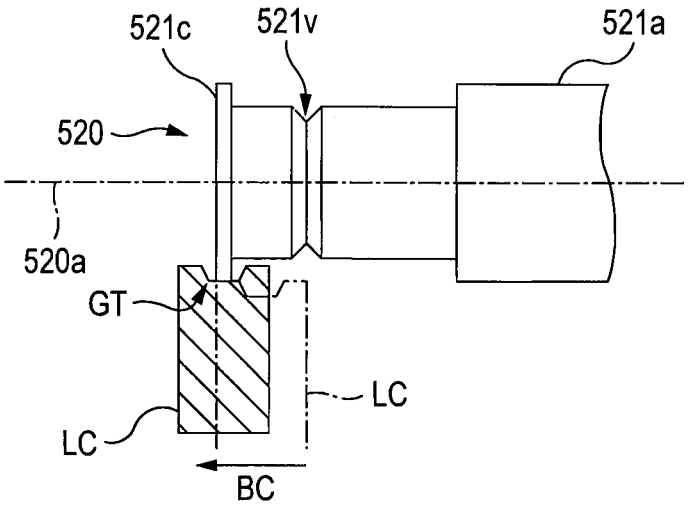
FIG. 14 is an explanatory view of a measurement of a groove position.

Subsequently, the control unit is shifted to a measuring process of the position of the groove and the size of the groove. After the control unit 50 moves the chuck shafts to locate the chuck shafts 102L and 102R at a measuring position (see FIG. 7), under a state that the control unit controls the protruding part 521*c* of the tracing stylus 520 to contact with the flat surface of the lens LC, the control unit moves the lens LC in a direction shown by an arrow mark BC as shown in FIG. 14. According to the movement of the lens LC, when the protruding part 521*c* enters a groove GT formed in the lens LC, a variation of the protruding part 521*c* is detected by the encoder 511. A position in the X-axis direction at this time is read by the encoder 146 to obtain the position of the groove in the X-axis direction. The position of the groove is compared with groove position data before a calibration to obtain corrected data of the position of the groove.

Further, the protruding part 521*c* is brought into contact with the grooves GT formed in the circular areas 722 of the four parts to obtain the actual depth of the groove processed in the lens LC and calibration data of the depth of the groove based on a distance measured by the encoder 511 at this time and a previously measured distance of the flat-finished surface parts.

<Third Processing Step>

Figure 15:
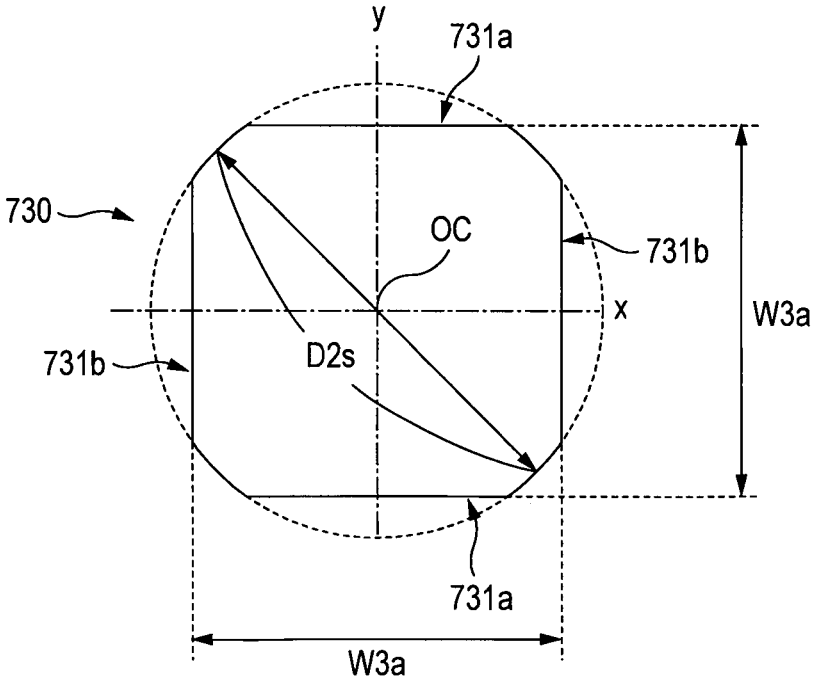
FIG. 15 is a diagram of a target lens shape in a third processing step.

In a third processing step, a processing work is carried out for calibrating the axial angle of the flat-finished part and the axial angle of the groove part. FIG. 15 is a diagram showing a target lens shape 730 in the third processing step. As to the target lens shape 730, the size W3*a* of linear areas 731*a* and 731*b* is set to a size (=49 mm) smaller than W1*a* (=51 mm) of the target lens shape 700 so that bevels of the linear areas 701*a* and 701*b* which are not process in the target lens shape 720 are cut and flat-finished.

The control unit 50 flat-finishes the linear areas 731*a* and 731*b* by the flat-finishing surface of the finishing grindstone 164B according to the target lens shape 730 and then carries out a grooving work by the cutter 436. After the processing work is completed, in the same manner as in FIG. 12, the control unit 50 rotates the lens LC so that the y-axis direction (or the x-axis direction) of the target lens shape 730 corresponds to the Y-axis direction of the device 1, and then, the control unit 50 controls the cylindrical part 521*a* of the tracing stylus 520 to contact the linear area 731*b* (or 731*a*) of the flat-finished part processed in the lens LC. Under this state, the control unit drives the motor 150 of the Y-axis to relatively move the lens LC by a predetermined distance ΔY in the Y-axis direction. Variation information Δd of the tracing stylus 520 at this time is obtained from the output of the encoder 511. corrected (calibration) data of the axial angle (AXIS) of the flat-finished part by the finishing grindstone 164B is obtained according to the distance ΔY and the variation information Δd.

Figure 12:
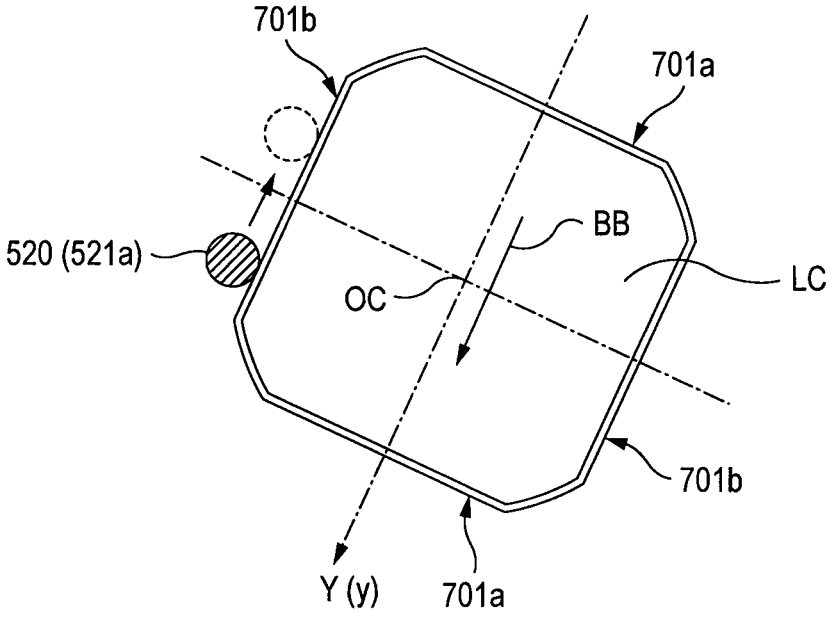
FIG. 12 is an explanatory view of a measurement of an axial angle in the bevel-finishing work.

Subsequently, in order to obtain corrected data of the axial angle of the grooving work, the protruding part 521*c* of the tracing stylus 520 is inserted into a groove part formed in the liner area 731*b* (or 731*a*) and the lens LC is relatively moved by a distance ΔY in the Y-axis direction as shown in FIG. 12. Variation information Δd of the tracing stylus 520 at this time is obtained from the output of the encoder 511. The corrected data of the axial angle of the grooving work by the cutter 436 as the grooving tool is obtained according to the distance ΔY and the variation information Δd.

In the flat-finishing work and the grooving work, areas which the measuring parts of the tracing stylus 520 respectively contact are the linear areas 731*a* and 731*b* of four parts and the corrected data of the axial angle may be set to an average of the data obtained in the four parts.

<Fourth Processing Step>

Figure 16:
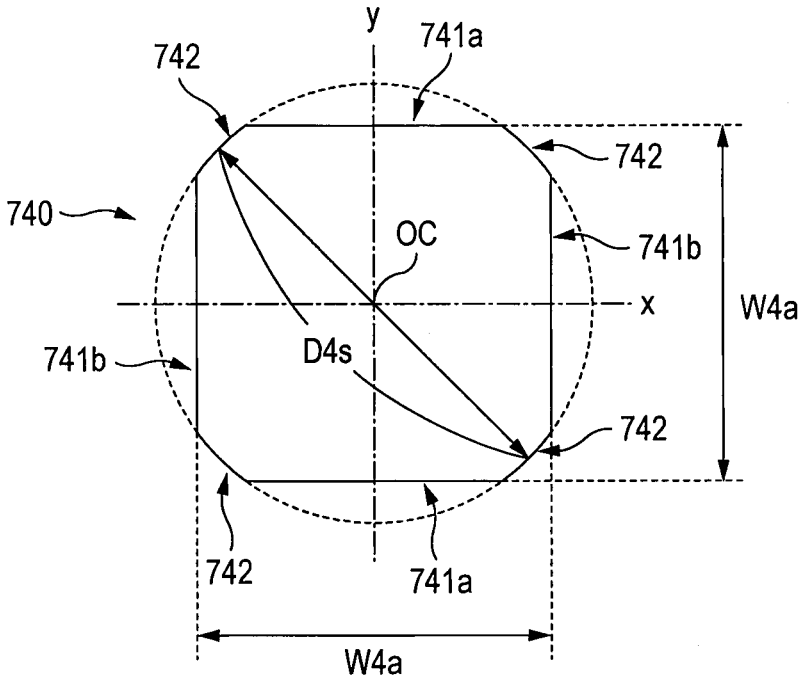
FIG. 16 is a diagram of a target lens shape in a fourth processing step.

In a fourth processing step, in order to calibrate a chamfered width by the chamfering grindstones 221*a* and 221*b* of the chamfering unit 200, the lens LC is chamfered. FIG. 16 is a diagram showing a target lens shape 740 in the fourth processing step. Circular areas 742 in four parts of the target lens shape 740 are set to have a diameter D4*s* (=58 mm) smaller than the diameter D2*s* of the circular areas 722 so that the grooved parts of the circular areas 722 of the target lens shape 730 in the previous process are cut. Further, the size W4*a* of linear areas 741*a* and 741*b* is set to a size (=47 mm) smaller than the size W3*a* so that the groove parts processed in the target lens shape 730 of the previous process are cut.

The control unit 50 operates the lens edge position detecting units 300F and 300R to measure the edge position of the front surface and the edge position of the rear surface of the lens LC and flat-finishes the circular areas 742 of the four parts and the linear areas 741*a* and 741*b* by the flat-finishing surface of the finishing grindstone 164B. After that, the control unit moves the rotating shaft 230 of the chamfering unit 200 to a predetermined processing position (a position on the Y-axis) to process the front surface of the lens of the flat-finished circular areas 742 by the chamfering grindstone 221*a* and the rear surface of the lens of the circular areas 742 by the chamfering grindstone 221*b*. Chamfered data at this time is set so that the chamfered width between the front surface and the rear surface has a predetermined width F4*a* (=0.3 mm) based on the measured results of the edge positions of the front surface and the rear surface of the lens LC.

Figure 17:
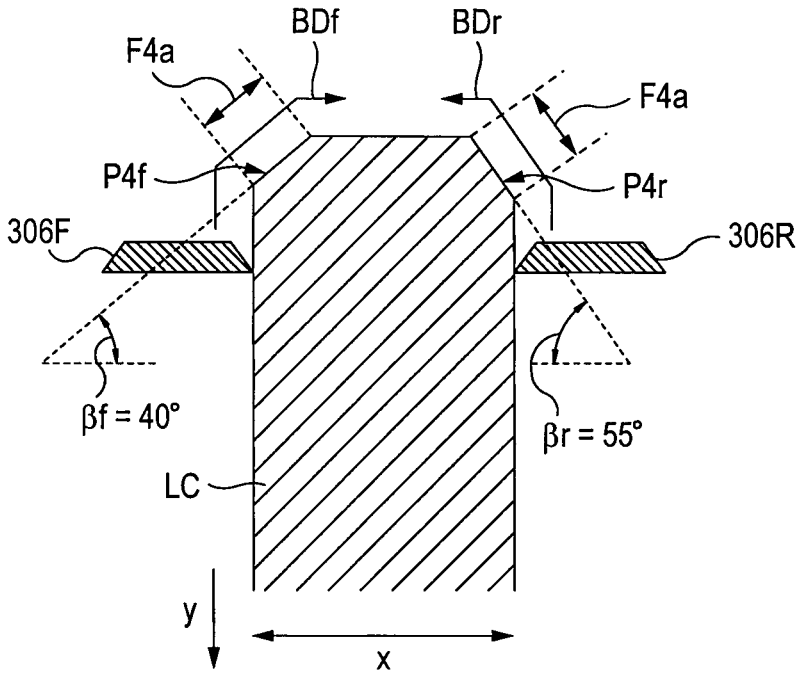
FIG. 17 is an explanatory view of a measuring process of a chamfered width.

After the chamfering work is finished, the control unit is shifted to a measuring process of the chamfered width. FIG. 17 is a diagram for explaining the measuring process of the chamfered width. In the measuring process of the chamfered width, the lens edge position detecting units 300F and 300R are commonly used as a measuring mechanism of the chamfered width. The control unit 50 rotates the lens LC (the chuck shafts 102L, 102R) according to the target lens shape 740 to locate one of the four chamfered circular areas 74 on the Y-axis. After that, as shown in FIG. 17, after the control unit 50 controls the tracing stylus 306F of the detecting unit 300F to contact the front surface of the LC based on the target lens shape 740, the control unit lowers the lens LC in the Y-axis direction. At this time, the tracing stylus 306F is relatively moved as shown by an arrow mark BDf and the shape of the front surface of the lens including the chamfered part P4*f* is detected by the encoder 313F. Further, similarly, after the control unit 50 controls the tracing stylus 306R of the detecting unit 300R to contact the rear surface of the LC based on the target lens shape 740, the control unit lowers the lens LC in the Y-axis direction. At this time, the tracing stylus 306R is relatively moved as shown by an arrow mark BDr and the profile of the rear surface of the lens including the chamfered part P4*r* is detected by the encoder 313R. A position where the tracing stylus 306F initially contacts the front surface of the lens is set, according to the diameter of the circular area of the target lens shape 740, to a position a predetermined amount lower than a position estimated to include the chamfered part P4*f* on FIG. 17. A position where the tracing stylus 306R contacts the rear surface of the lens is set in the same manner as described above.

For the profile data detected by the encoder 313F, the control unit 50 searches, according to a tilt angle βf (a tilt angle=40° relative to the X-axis direction) of the chamfering grindstone 221*a* of the front surface of the lens, a straight line when data corresponding to the straight line of the tilt angle βf (or data located within a tolerance) is most detected to obtain a first intersection of the straight line of the chamfered surface and the front surface of the lens and a second intersection of the straight line of the chamfered surface and the peripheral edge of the lens, so that the control unit can obtain a chamfered width F4*af* of the chamfered part P4*f*. Then, the control unit 50 obtains calibration data of the chamfering work by the chamfering grindstone 221*a* so that the measured width F4*af* is a width F4*a* as a setting value. For the profile data detected by the encoder 313F, the control unit 50 obtains, according to a tilt angle βr (a tilt angle=55° relative to the X-axis direction) of the chamfering grindstone 221*b* of the rear surface of the lens, a chamfered width F4*ar* of the chamfered part P4*r* by the same calculation and calibration data of the chamfering work by the chamfering grindstone 221*b*. The chamfering work by the chamfering grindstones 221*a* and 221*b* can be realized by controlling a position in the X-axis direction where the lens LC held by the chuck shafts 102L and 102R is moved with the position in the Y-axis direction fixed or by controlling a position in the Y-axis direction where the lens LC is moved with the position in the X-axis direction fixed. When the chamfering work is carried out by moving the lens LC in the X-axis direction, a difference ΔF4*a* between the measured width F4*af* and the width F4*a* as the setting value is obtained and according to the difference ΔF4*a* and the tilt angle βf of the grindstone 221*a*, calibration data in the X-axis direction for correcting the difference ΔF4*a* is obtained.

<Fifth Processing Step>

Figure 18:
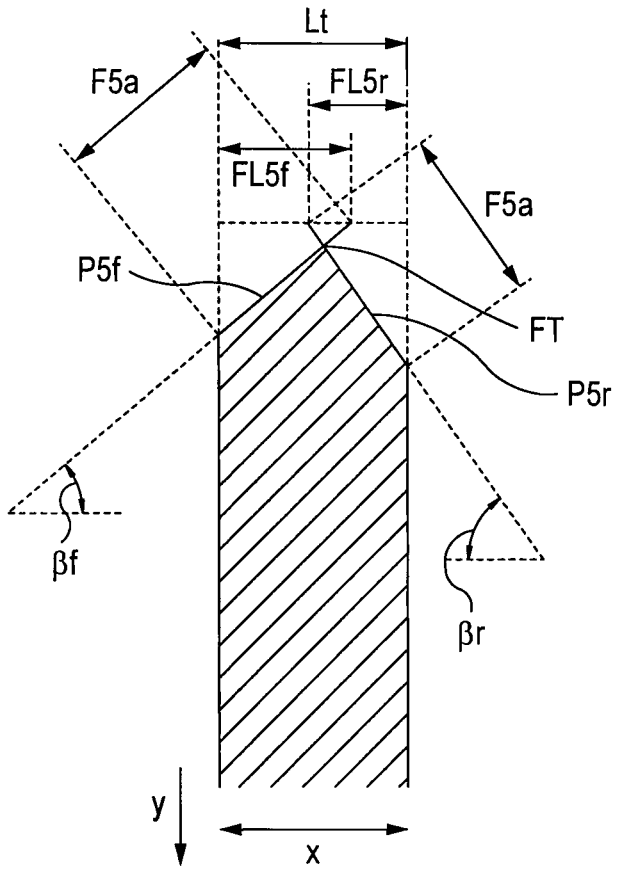
FIG. 18 is a diagram for explaining a setting of the chamfered width.

In a fifth processing step, in order to calibrate the axial angle of the chamfering work, the front surface and the rear surface of the lens are respectively additionally chamfered with a chamfered width F5*a* set to be larger than the chamfered width F4*a* in the fourth processing step. The chamfered width F5*a* is set, as shown in FIG. 18, in such a way that a total of a chamfered distance FL5*f* of the front surface of the lens in the direction of thickness of the edge and a chamfered distance FL5*r* of the rear surface of the lens exceeds the thickness Lt of the edge of the lens, for instance, when the thickness Lt of the edge is 2.5 mm, F5*a* is set to 2.3 mm. At this time, a chamfering apex FT at which a chamfered surface P5*f* of the front surface of the lens intersects a chamfered surface P5*r* of the rear surface of the lens is located inside the edge surface of the lens.

The control unit 50 chamfers respectively the front surface and the rear surface of the lens in the linear areas 741*a* and 741*b* by the chamfering grindstones 221*a* and 221*b* with the chamfered width F5*a* according to the target lens shape 740 shown in FIG. 16.

Figure 19:
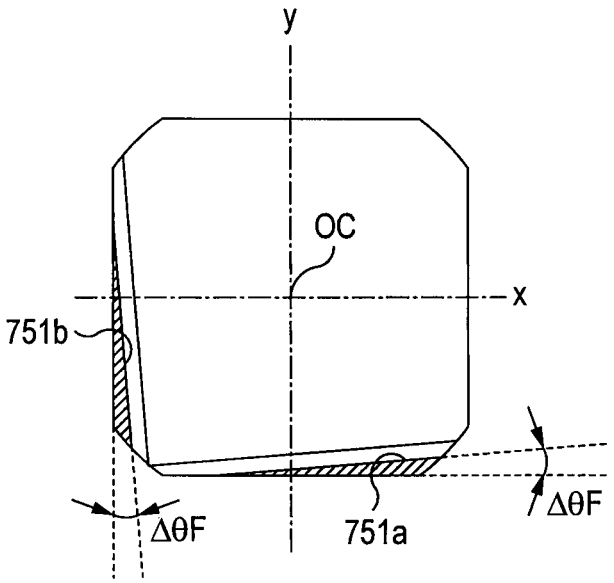
FIG. 19 is a schematic diagram of a lens viewed from a front surface side after a chamfer-finishing work.

FIG. 19 is a schematic diagram showing the lens LC viewed from a front surface after the chamfering work. In the chamfering work, when the axial angle (AXIS) does not deviate, the path of the chamfering apex FT after the processing work is parallel to the y-axis and the x-axis of the target lens shape respectively. However, when the axial angle deviates during the chamfering work, as shown in FIG. 19, a path 751*b* of the chamfering apex FT after the processing work which corresponds to the linear area 741*b* of the target lens shape and a path 751*a* of the chamfering apex FT after the processing work which corresponds to the linear area 741*a* of the target lens shape respectively deviate by angle ΔθF from the y-axis and the x-axis.

After the control unit 50 rotates, as shown in FIG. 12, the lens LC so that the y-axis direction (or the x-axis direction) of the target lens shape corresponds to the Y-axis direction of the device 1, the control unit 50 controls the cylindrical part 521*a* of the tracing stylus 520 to contact the chamfering apex FT corresponding to the linear area 741*b* of the target lens shape. Under this state, the control unit relatively moves the lens LC by an area where the chamfering apex FT exists in the Y-axis direction. Variation information ΔdF of the tracing stylus 520 at this time is obtained from the output of the encoder 511. The angle ΔθF is obtained according to a distance ΔYF in the Y-axis direction, where the variation information ΔdF is distributed, and the variation information ΔdF. The angle ΔθF is taken as calibration data of the axial angle during the chamfering work.

<Sixth Processing Step>

Figure 20:
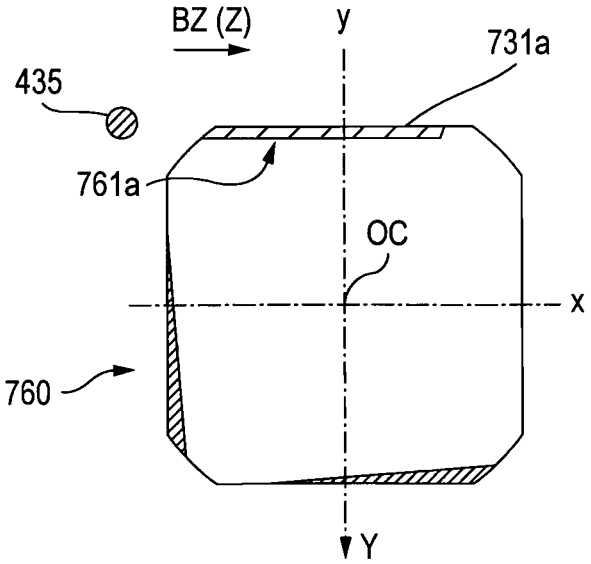
FIG. 20 is a diagram for explaining a linear processing work by a drilling tool.

In a sixth processing step, in order to calibrate the axial angle (AXIS) during a linear processing work by the end mill (the drilling tool) 435 of the drilling and grooving unit 400, the peripheral edge of the lens LC is processed by a side surface of the end mill. FIG. 20 is a diagram for explaining the linear processing work by the end mill 435. For the linear area 731*a* of the target lens shape which is left in the previous processing step for calibrating the chamfering work, a linear area 761*a* parallel to the x-axis of an a target lens shape is processed. The control unit 50 rotates a rotating angle of the end mill 435 so as to be parallel to the X-axis. Further, the control unit controls the y-axis direction of the target lens shape to correspond to the Y-axis direction of the device 1, and then, drives the motor 405 of the unit 400 to relatively move the end mill 435 in a direction Z as shown by an arrow mark BZ in FIG. 20 and process the processing area 761*a* by the end mill 435.

After the area 761*a* is processed, the control unit 50 rotates the lens LC in the same manner as that of FIG. 12 so as to control the x-axis direction of the target lens shape to correspond to the Y-axis direction of the device 1, and then, under a state the control unit controls the cylindrical part 521*a* of the tracing stylus 520 to contact the area 761*a*, the control unit moves the lens LC in the Y-axis direction to obtain variation information of the area 761*a*. Thus, the control unit obtains calibration data of the axial angle during the linear processing work by the end mill (the drilling tool) 435.

<Seventh Processing Step>

Figure 21:
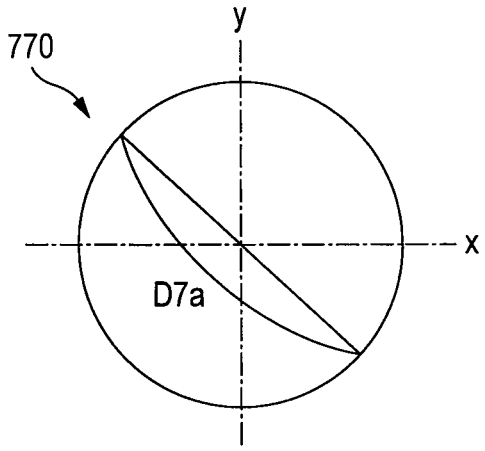
FIG. 21 is a diagram of a target lens shape in a seventh processing step.

A seventh processing step carries out a processing work for calibrating a processing position (a position in the X-axis direction) by the grindstone 163A for processing the front bevel and the grindstone 163B for processing the rear bevel which are used during the processing work of the bevel of the high curve lens. FIG. 21 shows a target lens shape 770 of the seventh processing step. The target lens shape 770 has a circular shape with a diameter D7*a* and the diameter D7*a* (=43 mm) of the circular shape 770 is set so that the processed parts up to the sixth processing step are cut off to carry out a flat-finishing work and a bevel-finishing work.

Figure 22:
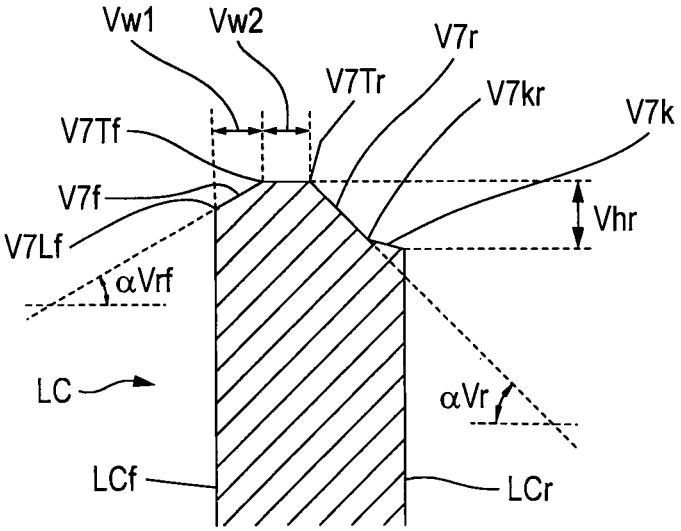
FIG. 22 is a diagram for explaining a processing work of a lens by a bevel-finishing tool for a high curve lens.

The control unit 50 controls the lens edge position detecting units 300F and 300R to obtain the edge positions of the front surface and the rear surface of the lens according to the target lens shape 770. Subsequently, the control unit roughly processes the lens LC by the rough grindstone 162 according to the target lens shape 770 and then flat-finishes the lens LC by the flat-finishing grindstone 164B. After that, according to beveling data calculated based on the detected result of the edge positions, the control unit processes the front bevel V7*f* of the lens LC by the grindstone 163A and processes the rear bevel V7*r* by the grindstone 163B as shown in FIG. 22. In the rear surface side of the lens, the rear bevel foot V7*k* is also processed by the rear bevel foot processing surface 163Bk of the grindstone 163B.

In the calculation of the beveling data, for instance, an apex distance Vw1 of the front bevel V7*f* to the front surface of the lens in the edge direction (the X-axis direction) of the lens, an apex distance Vw2 of the rear bevel to the apex of the front bevel V7*f* and a height distance Vhr of the apex of the rear bevel are set in advance. The processing data of the front bevel V7*f* by the grindstone 163A is determined by the front surface position data of the lens detected by the detecting unit 300F before the processing work and the set value of the apex distance Vw1. The processing data of the rear bevel V7*r* by the grindstone 163B is determined according to the rear surface position data of the lens detected by the detecting unit 300R and the set values of the distance Vw2 to the apex distance Vw1 and the height distance Vhr.

After the beveling work is completed, the control unit 50 controls the tracing stylus 306F of the detecting unit 300F to contact the front surface LCf of the lens LC according to the target lens shape 770 and the front beveling data similarly to the measuring process of the chamfered width shown in FIG. 17, and then lowers the lens LC in the Y-axis direction to obtain the profile (a position in the X-axis direction to a reference position) of the front surface LCf of the lens and the front bevel V7*f*. Further, the control unit controls the tracing stylus 306R of the detecting unit 300R to contact the rear surface LCr of the lens LC according to the target lens shape 770 and the rear beveling data, and then lowers the LC in the Y-axis direction to obtain the profile (a position in the X-axis direction to a reference position) of the rear surface LCr of the lens, the rear bevel V7*r* and the rear bevel foot V7*k*.

Then, the control unit 50 searches, according to a tilt angle αVf (=30°) of the grindstone 163A relative to the X-axis, a straight line when data corresponding to the straight line of the tilt angle αVf (or data located within a tolerance) is most detected. Then, by obtaining a profile at both ends at that time, the control unit obtains a position of a front bevel apex V7Tf in the X-axis direction and a position of an intersection V7Lf of the front surface LCf of the lens and the front bevel V7*f* in the Y-axis direction. Thus, calibration data of the position of the grindstone 163A in the X-axis direction is obtained for ensuring the apex distance Vw1.

Further, the control unit 50 searches, according to a tilt angle αVr (=45°) of the beveling surface 163Bv of the grindstone 163A relative to the X-axis, a straight line when data corresponding to the straight line of the tilt angle αVr (or data located within a tolerance) is most detected. Then, by obtaining a profile at both ends at that time, the control unit obtains a position of a rear bevel apex V7Tr in the X-axis direction and a position of an intersection V7*kr* of the rear bevel V7*r* and the rear bevel foot V7*k* in the Y-axis direction. Thus, calibration data of the position of the grindstone 163B in the X-axis direction is obtained for ensuring the distance Vw2 and the height distance Vhr.

<Eighth Processing Step>

In an eighth processing step, in order to calibrate a tilt angle of the end mill 435 as the drilling tool, the end mill 435 is inclined by a certain angle γ(=30°) to process the peripheral edge of the lens LC by the side surface of the end mill 435. A target lens shape 780 (an illustration is omitted) in this processing work is set to a circular shape having a diameter D8*a* (=41 mm) smaller than that of the target lens shape 770 of the previous processing step so that the bevel parts in the previous processing step are cut off. The control unit 50 controls the lens edge position detecting units 300F ad 300R to obtain the edge positions of the front surface and the rear surface of the lens according to the target lens shape 780. Subsequently, the control unit flat-finishes all the periphery of the lens LC by the flat-finishing grindstone 164B. When a margin allowed for finishing is larger than a reference amount, before the finishing or processing work by the flat-finishing grindstone 164B, the lens LC is roughly processed by the rough grindstone 162 according to the target lens shape 770.

Figure 23:
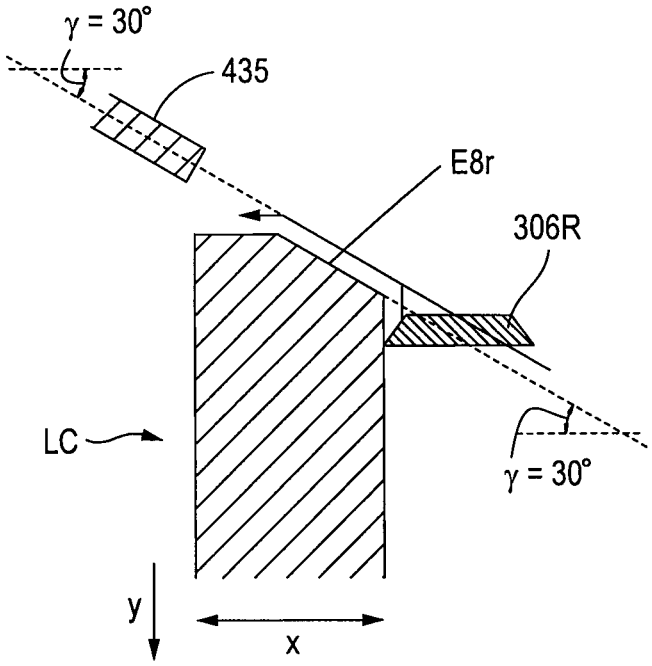
FIG. 23 is a diagram for explaining a processed shape when a tilt angle of the drilling tool is calibrated.

The control unit 50 drives the motor 416 to the edge surface of the flat-finished lens LC to tilt the end mill 435 by an angle γ(=30°) relative to the X-axis direction as shown in FIG. 23 and process a part of the rear surface side of the lens LC as in a chamfering work. The lens LC is rotated so that a processing range is one-fourth a circumference of the target lens shape 780. After the processing work is finished, as in the measuring process of the chamfered width shown in FIG. 17, the control unit controls the tracing stylus 306R of the lens edge position detecting unit 300R to contact the rear surface of the lens LC, and then lowers the lens LC in the Y-axis direction to obtain a profile of a processed part E8*r* by the end mill 435. Then, the control unit obtains an angle of linear data of the processed part E8*r* and compares the obtained angle with the setting angle γ to obtain calibration data of the tilt angle of the end mill 435.

<Ninth Processing Step>

Figure 24A:
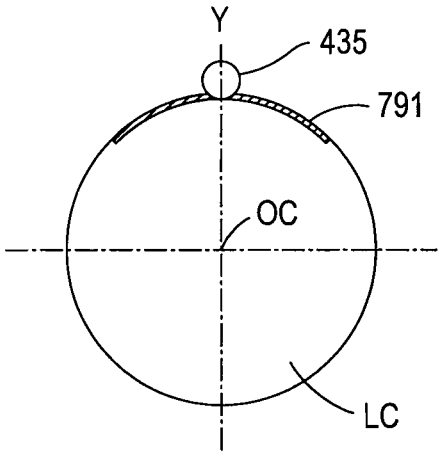
FIG. 24A and FIG. 24B are diagrams for explaining a processing work for calibrating a position of an origin of the drilling tool in a direction of Y and a direction of Z.
Figure 24B:
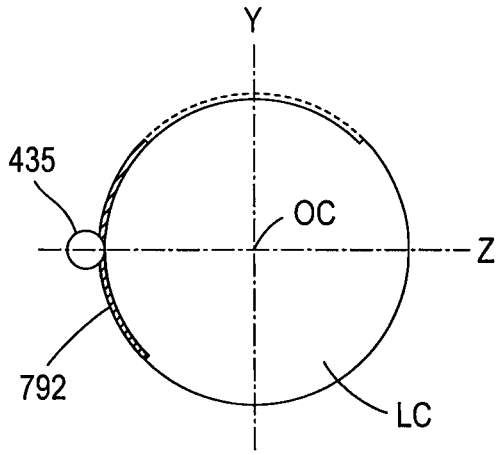

In a ninth processing step, a processing work is carried out for calibrating an origin position of the end mill 435 as the drilling tool in the vertical direction (the Y-axis direction) and the Z-axis direction (the direction orthogonal to the X-axis and the Y-axis). In the ninth processing step, the target lens shape 780 (the diameter of 41 mm) of the eighth processing step is used. Under a state that the control unit 50 locates the tilt angle of the end mill 435 at 0°, the control unit locates the end mill 435 on the Y-axis of the device 1 as shown in FIG. 24A, rotates the lens LC and controls the driving of the motor 150 to move the chuck shafts 102L and 102R in the Y-axis direction so that a circular area 791 one-fourth of the circular area left in the eighth processing step is cut off with a width of 0.4 mm. Then, the control unit 50 locates the lens chuck shafts 102L and 102R on the Z-axis of the drilling and grooving unit 400 as shown in FIG. 24B, rotates the lens LC and controls the driving of the motor 405 of the unit 400 to move the end mill 435 to the Z-axis direction so that a circular area 792 one-fourth in the circular area left in the previous processing step is further cut off with a width of 0.4 mm.

After the processing work of the circular areas 791 and 792 are finished, the control unit 50 locates the chuck shafts 102L and 102R at predetermined measuring positions for detecting the outside diameter and operates the lens outside diameter detecting unit 500 to control the tracing stylus 520 (the cylindrical part 521*a*) to contact the initially processed or finished circular area 791 and obtain the outside diameter size. Thus, the control part obtains calibration data of the origin position of the end mill 435 in the vertical direction (the Y-axis direction). Then, the control unit controls the tracing stylus 520 (the cylindrical part 521*a*) to contact the processed or finished circular area 792 to obtain the outside diameter size. Thus, the control unit obtains calibration data of the origin position of the end mill 435 in the Z-axis direction.

<Tenth Processing Step>

Figure 25A:
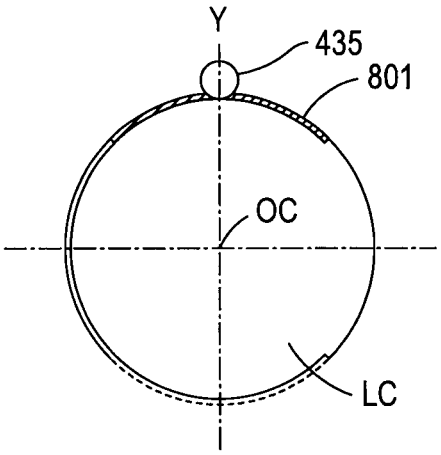
FIG. 25A and FIG. 25B are diagrams for explaining a processing work for calibrating the surface position of a hole by the drilling tool.
Figure 25B:
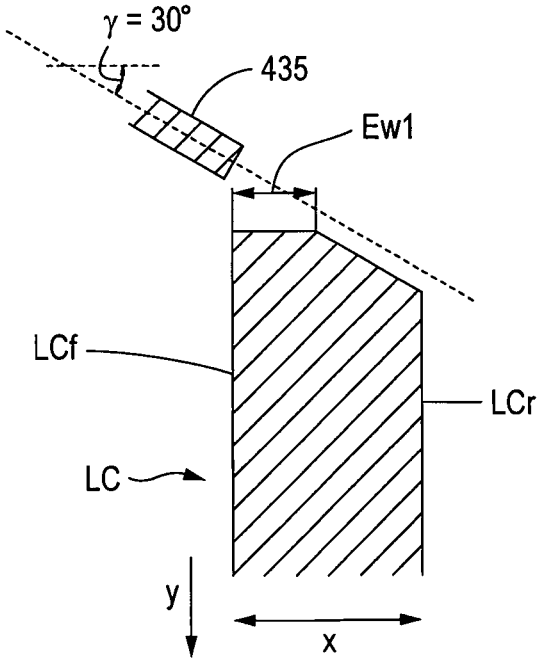

In a tenth processing step, a processing work is carried out for calibrating a hole surface position by the end mill 435 to the surface of the lens LC. In the tenth processing step, the target lens 780 (the diameter of 41 mm) of the eighth processing step is used. The origin position of the end mill 435 in the Y-axis direction and the Z-axis direction is calibrated in the previous step. As shown in FIG. 25A, under a state that the control unit 50 initially locates the tilt angle of the end mill 435 at 0°, the control unit locates the end mill 435 on the Y-axis of the device 1, rotates the lens LC and controls the driving of the motor 150 to move the chuck shafts 102L and 102R in the Y-axis direction so that a circular area 801 one-fourth of the circular area left in the ninth processing step is cut off with a width of 0.4 mm. Then, as shown in FIG. 25B, the control unit 50 locates the tilt angle of the end mill 435 at an angle γ (=30°) relative to the X-axis direction. Then, the control unit controls the driving of the motor 145 to move the chuck shafts 102L and 102R in the X-axis direction so that the edge surface of the lens LC is left by a predetermined distance Ew1 (for instance, 0.2 mm) from the surface LCf of the lens, and then, rotates the lens LC to move the chuck shafts 102L and 102R in the Y-axis direction to cut the rear surface Lcr side of the lens at the angle γ (=30°) as in the chamfering work. When a processing work is carried out to ensure the distance Ew1, if the profile of the surface LCf of the lens is necessary, the lens edge position detecting units 300F and 300R are operated before the processing work to detect the edge positions of the surface LCf of the lens and the rear surface LCr of the lens.

Figure 26:
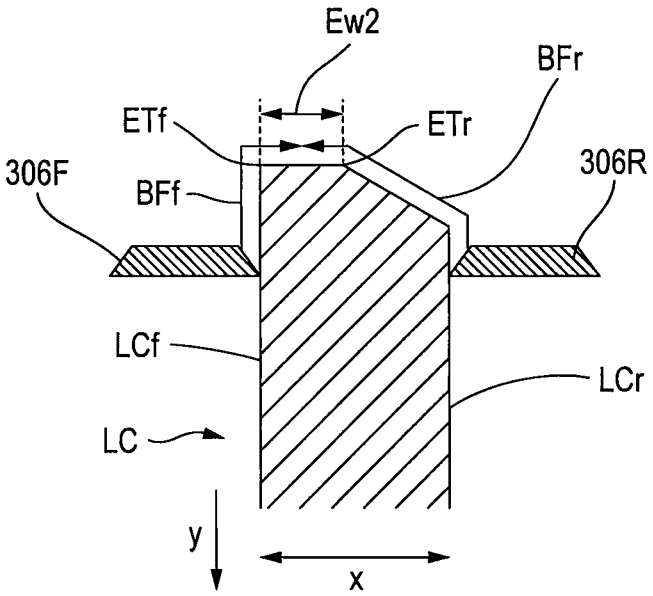
FIG. 26 is an explanatory view of a measuring process of a processed shape processed by the drilling tool.

After the processing work of the circular area 801 is finished, the control unit is shifted to a measuring process of a processed shape. As a measuring mechanism of the processed shape, the lens edge position detecting units 300F and 300R are commonly used like the measurement of the chamfered width. As shown in FIG. 26, the control unit 50 controls the tracing stylus 306F of the detecting unit 300F to contact the front surface LCf of the lens LC, and then, the control unit lowers the lens LC in the Y-axis direction. At this time, the tracing stylus 306F is relatively moved as shown by an arrow mark BFf and the profile of the front surface LCf side of the lens is detected by the encoder 313F. Then, in profile information obtained by the encoder 313F, a point sharply changing from a straight line (or a curved line) of the front surface LCF of the lens is obtained as an edge apex ETf (a position in the X-axis direction) of the front surface LCf side of the lens. Similarly, the control unit 50 controls the tracing stylus 306R of the detecting unit 300R to contact the rear surface LCr of the lens LC, and then, the control unit lowers the lens LC in the Y-axis direction. At this time, the tracing stylus 306R is relatively moved as shown by an arrow mark BFr and the profile of the rear surface LCr side of the lens is detected by the encoder 313R. Then, in profile information obtained by the encoder 313R, a point sharply changing from the straight line of the tilt angle γ (=30°) is obtained as an edge apex ETr (a position in the X-axis direction) of the rear surface LCr side of the lens.

A distance Ew2 in the X-axis direction is obtained based on the edge apex ETf and the edge apex ETr. A deviation amount ΔEw between the distance Ew1 as a setting value and the distance Ew2 after the processing work is calculated to obtain calibration data of the lens surface position during the processing work.

As a calibration item of the end mill 435 as the drilling tool, a reference of an end position of the end mill 435 needs to be determined. Especially, when the depth of a hole from the surface of the lens is set, it is important to calibrate the end position of the end mill 435. In a usual calibrating operation of the end position of a drilling tool, after the lens is actually drilled, an operator visually recognizes a processed state and carries out an operation for changing adjusting parameters stores in a memory. However, this calibrating operation requires excessively much labor and time. An operator who is not accustomed to the calibrating operation makes an error in operation or a misjudgment, so that the operator hardly calibrate the end position of the drilling tool accurately and properly. Further, when a detecting mechanism for the end position of the drilling tool is newly added, a cost of the device is increased.

Figure 27:
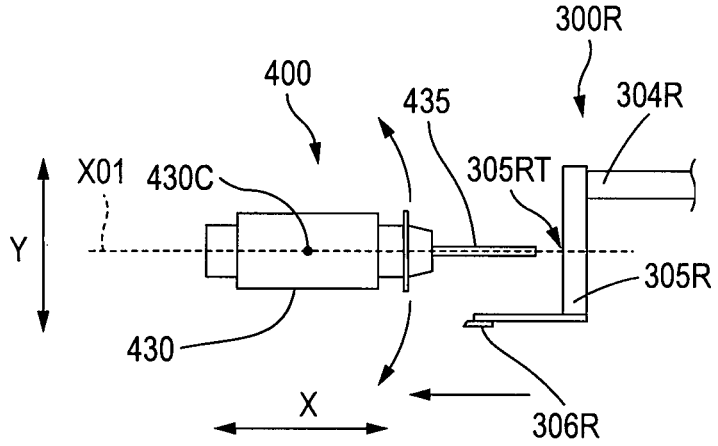
FIG. 27 is an explanatory view when an end position of the drilling tool is detected by the lens edge position detecting unit.

For this calibration, in the present device, the lens LC is not actually processed and the detecting unit 300R is commonly used. As shown in FIG. 27, the control unit 50 controls the driving of the motor 405 of the drilling and grooving unit 400 to move the end mill 435 in the Z-axis direction to a position corresponding to the hand 305R of the lens edge position detecting unit 300R. In FIG. 27, a left side surface of the hand 305R is set as a contact part 305RT with which an end of the end mill 435 contacts. Further, the control unit 50 controls the driving of the motor 416 so that a tilt angle of the end mill 435 is set to 0° (parallel to the X-axis). Namely, the control unit 50 rotates the rotating part 430 on the center of tilt 430C of the rotating support base 410 to locate the end direction of the end mill 435 to be parallel to the X-axis direction (the lens chuck shafts 102R and 102L). The center of tilt 430C is arranged so as to be located on an axis X01 where the contact part 305RT is moved in the X-axis direction.

Under this state, the control unit 50 drives the motor 316R to move the hand 305R of the lens edge position detecting unit 300R located at a retracted position to the end mill 435 side along the X-axis. The control unit detects that the hand 305R (the contact part 305RT) contacts the end of the end mill 435 from the output of the encoder 313R as a sensor. When the control unit detects that the hand 305R contacts the end of the end mill 435, the control unit stops the movement of the hand 305R and obtains a contact position of the hand 305R. Thus, calibration data of the end position of the end mill 435 (the position of the device in the X-axis direction relative to a reference position) is obtained. The contact side (the contact part 305RT) of the hand 305R with the end mill 435 is formed vertically to the X-axis and the position thereof is calibrated in advance. The obtained calibration data is stored in the memory 51.

Figure 28:
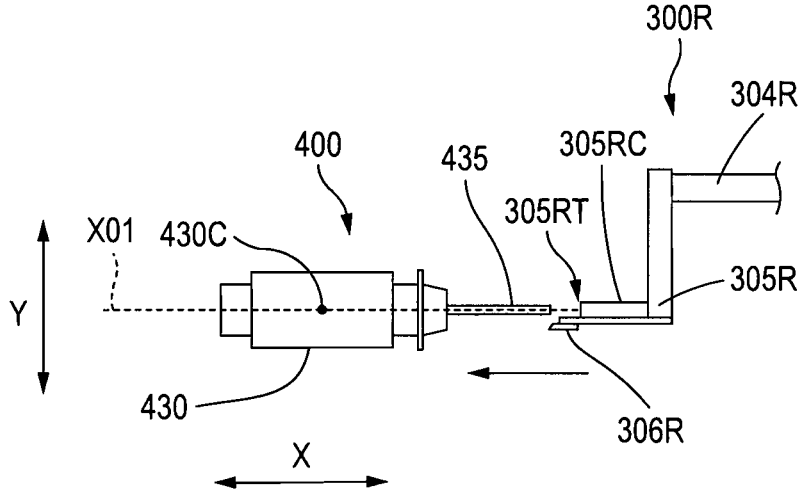
FIG. 28 is a modified example when the lens edge position detecting unit is also used as an end position detecting unit of the drilling tool.

FIG. 28 is a modified example in which the lens edge position detecting unit 300R is also used as an end position detecting unit of the end mill 435. In FIG. 28, the contact part 305RT which contacts the end mill 435 is provided in an upper part of the hand 305Ra which holds the tracing stylus 306R and extends in parallel with the X-axis direction and arranged at a position near the tracing stylus 306R. When the end mill 435 is arranged in parallel with the X-axis, the tracing stylus 306R comes close to the end mill 435, and as shown in FIG. 27, the contact part 305RT is located in a part of the hand 305R largely separated rightward from the tracing stylus 306R. In this case, when the hand 305R is moved to the end mill 435 side, the tracing stylus 306R tends to interfere with the rotating part 430. Accordingly, in the example shown in FIG. 28, in an upper part of the hand 305Ra extending in parallel with the X-axis direction, a block 305Rc is formed and the contact part 305RT is provided in the end mill side of the block 305Rc so that the contact part 305RT is located in the vicinity of the tracing stylus 306R. The center of tilt of 430C of the end mill 435 is located on the moving axis X01 where the contact part 305RT is moved in the X-axis direction. Then, when the end position of the end mill 435 is detected, the motor 405 is driven, and the rotating part 430 is moved to the lens chuck shaft side from its retracted position and stopped at a position where the end mill 435 can be located on the moving axis X01. Further, the motor 416 is driven so that the end mill 435 is arranged in parallel with the lens chuck shafts. After that, the arm 305R of the detecting unit 300R is moved to the end mill 435 side and the control unit 50 detects that the contact part 305RT contacts the end of the end mill 435 according to an output signal of the encoder 313R to obtain calibration data of the end position of the end mill 435.

A calibrating operation of the end position of the end mill 435 is preferably carried out after the calibration of the tilt angle of the end mill 435 in the above-described eighth processing step and before the calibration of the hole surface position of the tenth processing step. When only the end position of the end mill 435 needs to be calibrated as in the exchange of the end mill 435, an independent calibration may be carried out by the switch arranged in the display 5.

Further, as the detecting mechanism of the end position of the end mill 435, the lens edge position detecting unit 300R may be also used for detecting the damage of the end mill 435. In the drilling work of the lens LE, hole position data (a hole position of the lens with respect to the center of the chuck) on the surface of the lens, and hole data such as depth data of the hole, tilt angle data of the hole or the like are inputted to the display 5. The lens edge position detecting unit 300F is initially driven according to the hole position data to detect the position on the surface of the lens in the X-axis direction in which the drilling work is carried out. According to the detected position of the surface of the lens and the inputted hole data, the unit 400 is driven to carry out the drilling work by the end mill 435. In the drilling work, before the drilling work of the lens LE or after the drilling work, the control unit 50 carries out a detecting operation as shown in FIG. 27 (FIG. 28). When the end position of the end mill 435 is not detected in a reference position (a calibrated position) stored in advance in the memory 51, it is decided that the end mill 435 is broken, and before the drilling work, the drilling work is interrupted and a warning message is displayed on the display 5. Thus, an operator can know the damage of the end mill 435 and replace the end mill 435 by a new end mill at a proper timing.

As described above, in calibrating the end position of the drilling tool (the end mill 435), since the lens edge position detecting unit 300R is also used as the end position detecting unit of the drilling tool, an exclusively used detecting mechanism does not need to be newly provided and a calibration can be automated. Thus, the high cost of the device can be avoided, and the drilling tool can be accurately and efficiently constructed. Further, since the damage of the drilling tool is detected by using the detecting unit 300R, the operator can be prevented from knowing the damage of the drilling tool to produce a defective lens.

In such a way, when the collective calibration mode is selected, since the first processing step to the tenth processing step are continuously and automatically carried out and the device 1 itself obtains the calibration data, the labor of the operator is reduced to efficiently realize a calibration. Further, for the calibration item of each processing tool, since the target lens shape is set to be sequentially small, the number of the calibrating lenses LC used for calibration can be suppressed, which is economically advantageous. In the above-described exemplary embodiment, the first processing step to the tenth processing step may be combined together so as to realize these processing steps by using one lens LC.

The above-described collective calibration mode is mainly used during the production of the device and during the installation of the device. When a processing tool of one unit is exchanged, a unit having other processing tool does not need to be calibrated. Thus, in this case, a specific unit calibration mode is conveniently used. Now, the specific unit calibration mode will be described below. In the specific unit calibration mode, are prepared a first unit calibration mode of the spindle 161*a* in which an outside diameter processing grindstone such as the finishing grindstone 164 is arranged, a second unit calibration mode of the chamfering unit 200 and a third unit calibration mode of the drilling and grooving unit 400, and the calibration modes are respectively selected by switches 5*b*, 5*c* and 5*d* on the screen shown in FIG. 8.

When the first unit calibration mode is selected, the first processing step, the second processing step, the third processing step excluding the grooving work and the seventh step related to the grindstones 163 and 164 are carried out in order. When the second unit calibration mode is selected, the fourth processing step and the fifth processing step related to the calibration of the chamfering grindstone are carried out in order. When the third unit calibration mode is selected, the second processing step (excluding a calibration related to the flat-finishing work), third processing step (excluding a calibration related to the flat-finishing work), the sixth processing step, the eighth processing step, the ninth processing step and the tenth processing step are carried out in order.

In such a way, since the calibration mode for each unit can be selected, when the collective calibration is not necessary, a calibration can be more efficiently carried out and the number of lenses LC can be reduced. It is to be understood that an independent calibration can be selected, not for each unit, but for each processing tool or for each calibration item by a switch whose illustration is omitted.

What is claimed is:

1. An eyeglass lens processing apparatus for processing a peripheral edge of an eyeglass lens, the eyeglass lens processing apparatus comprising:

a processing unit including a lens chuck shaft for holding the eyeglass lens and a plurality of processing tools configured to process the peripheral edge of the eyeglass lens held by the lens chuck shaft;

a calibrating lens;

a mode selector configured to select a calibration mode;

a memory configured to store calibration processing data for processing the calibrating lens to a predetermined shape;

a detecting unit including a tracing stylus configured to contact a surface of the calibrating lens which is processed by the processing unit based on the calibration processing data to detect the shape of the processed calibrating lens in the calibration mode; and a calculating unit configured to obtain calibration data by comparing a detected result by the detecting unit with the calibration processing data in the calibration mode.

2. The eyeglass lens processing apparatus according to claim 1, wherein the calibrating lens includes a plane plate exclusively used for calibration.

3. The eyeglass lens processing apparatus according to claim 2, wherein the calibrating lens has a circular shape or a square shape.

4. The eyeglass lens processing apparatus according to claim 2, wherein the processing unit includes a plurality of processing shafts to which the processing tools are respectively attached, the mode selector can select one of a collective calibration mode and a specific unit calibration mode for specific processing shafts, and in the collective calibration mode, calibration items for the processing tools respectively attached to the processing shafts are carried out in a predetermined order.

5. The eyeglass lens processing apparatus according to claim 4, wherein the calibration items of the collective calibration mode includes a calibration item for a processing shaft to which a bevel-finishing tool is attached, a calibration item for a processing shaft to which a flat-finishing tool is attached and a calibration item for a processing shaft to which a chamfering tool is attached.

6. The eyeglass lens processing apparatus according to claim 1, wherein the calibration processing data includes first calibration processing data of a first calibration item and second calibration processing data of a second calibration item, the first calibration processing data is for processing the calibrating lens to a first diameter, and the second calibration processing data is for processing the calibrating lens to a second diameter, and the second diameter is smaller than the first diameter so that the calibrating lens processed based on the first calibration processing data can be further processed based on the second calibration processing data.

7. The eyeglass lens processing apparatus according to claim 1, wherein the tracing stylus include a first tracing stylus portion configured to contact the peripheral edge of the processed calibrating lens, a second tracing stylus portion having a V groove configured to contact a bevel formed in the peripheral edge of the processed calibrating lens and a third tracing stylus portion having a protruding part configured to be inserted into a groove formed in the peripheral edge of the processed calibrating lens.

8. The eyeglass lens processing apparatus according to claim 1, wherein the tracing stylus includes a tracing stylus portion configured to contact the peripheral edge of the calibrating lens, and the tracing stylus portion is used as a tracing stylus for measuring an outside diameter of the eyeglasses leans which is not processed when a processing mode for processing the eyeglass lens is selected by the mode selector.

9. The eyeglass lens processing apparatus according to claim 1, wherein the tracing stylus includes tracing stylus portions contact a front surface and a rear surface of the calibrating lens, respectively, and the tracing stylus portions are used as tracing styluses for detecting edge positions of the eyeglass lens to be processed by the processing unit when a processing mode for processing the eyeglass lens is selected by the mode selector.

10. The eyeglass lens processing apparatus according to claim 1, wherein the processing unit includes a drilling unit having a drilling tool for drilling the eyeglass lens held by the lens chuck shaft, the detecting unit includes a lens edge position detecting unit including a tracing stylus portion configured to contact a refracting surface of the eyeglass lens and a sensor for detecting an axial movement of a holding member for holding the tracing stylus portion and detects the edge position of the eyeglass lens based on an output signal from the sensor, the lens edge position detecting unit detects an end position of the drilling tool, and the eyeglass lens processing apparatus further comprises a drilling tool calibration control unit configured to obtain calibration data for the end position of the drilling tool based on the output signal from the sensor when a predetermined contact part of the holding member contacts the end of the drilling tool in the calibration mode.

11. The eyeglass lens processing apparatus according to claim 10, wherein the drilling unit includes a tilting unit configured to tilt the drilling tool relative to the lens chuck shaft so that a center of the tilt of the drilling tool is located on an axis of the movement of the contact part which is moved in parallel with the lens chuck shaft, and the drilling tool calibration control unit controls the tilting unit during the calibration mode of the drilling tool to locate an end direction of the drilling tool in the axial direction of the movement of the contact part.

* * * * *